US008763510B2

(12) United States Patent
Dueck et al.

(10) Patent No.: US 8,763,510 B2
(45) Date of Patent: Jul. 1, 2014

(54) BLANK SAFETY DEVICE AND FIREARM ADAPTER

(75) Inventors: Barry W. Dueck, Corona, CA (US); Karl Honigmann, Anaheim Hills, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/526,082

(22) Filed: Jun. 18, 2012

(65) Prior Publication Data

US 2013/0000170 A1 Jan. 3, 2013

Related U.S. Application Data

(63) Continuation-in-part of application No. 12/774,500, filed on May 5, 2010, now Pat. No. 8,201,487, which is a continuation-in-part of application No. 12/482,664, filed on Jun. 11, 2009, now Pat. No. 8,091,462.

(60) Provisional application No. 61/637,833, filed on Apr. 24, 2012.

(51) Int. Cl.
*F41A 21/26* (2006.01)

(52) U.S. Cl.
CPC ..... *F41A 21/26* (2013.01)
USPC ..... 89/14.5; 89/14.4

(58) Field of Classification Search
CPC ..... F41A 21/26; F41A 21/32; F41A 21/325; F41A 21/00; F41J 13/00; F41C 27/00
USPC ..... 89/14.05, 14.5, 29, 30, 31; 42/1.05–1.06, 96, 105; 181/223; 102/485
See application file for complete search history.

(56) References Cited

U.S. PATENT DOCUMENTS

| | | | |
|---|---|---|---|
| 615,279 | A | 12/1898 | Jones |
| 720,688 | A | 2/1903 | Hagedorn |
| 1,394,490 | A | 10/1921 | Giles |
| 2,124,075 | A | 7/1938 | Moore |
| 2,222,334 | A | 11/1940 | Brouwer |
| 2,267,252 | A | 12/1941 | Pitsch |
| 2,412,409 | A | 12/1946 | Martin |
| 2,628,854 | A | 2/1953 | Gardner |
| 2,809,560 | A | 10/1957 | Matson et al. |
| 2,848,814 | A | 8/1958 | Musser |
| 2,859,058 | A | 11/1958 | Traugott |
| 3,029,540 | A | 4/1962 | Pachmayr |

(Continued)

FOREIGN PATENT DOCUMENTS

| | | |
|---|---|---|
| DE | 103 05 644 | 5/2004 |
| EP | 0 928 943 | 7/1999 |
| EP | 1 742 008 | 1/2007 |

*Primary Examiner* — Stephen M Johnson
*Assistant Examiner* — Joshua Freeman
(74) *Attorney, Agent, or Firm* — Haynes and Boone, LLP

(57) ABSTRACT

In one embodiment, a blank safety device is provided that includes: a body defining a cylindrical bore having a closed distal end, the body also defining an proximally extending internal cavity in communication with the cylindrical bore; a bullet plug received within the cylindrical bore, the bullet plug being configured to distally displace within the cylindrical bore towards the closed distal end in response to the impact of a fired bullet; and a back section received within the internal cavity in the body, the back section defining an internal chamber that is sealed with respect to a proximal bore for receiving a firearm attachment.

17 Claims, 39 Drawing Sheets

SECTION A–A

(56) References Cited

U.S. PATENT DOCUMENTS

| | | | | | |
|---|---|---|---|---|---|
| 3,123,929 | A | | 3/1964 | Pachmayr et al. | |
| 3,163,953 | A | | 1/1965 | Bridge, Sr. | |
| 3,245,350 | A | * | 4/1966 | Kelly | 89/1.808 |
| 3,257,108 | A | | 6/1966 | Pachmayr et al. | |
| 3,259,407 | A | | 7/1966 | Welt | |
| 3,440,924 | A | | 4/1969 | Sawyer | |
| 3,664,263 | A | | 5/1972 | Driscoll | |
| 3,698,747 | A | | 10/1972 | Wing et al. | |
| 3,726,036 | A | * | 4/1973 | Jennings et al. | 42/105 |
| 3,732,776 | A | * | 5/1973 | Snodgrass | 89/14.5 |
| 3,766,822 | A | | 10/1973 | Sophinos | |
| 4,134,175 | A | | 1/1979 | Contoyanis | |
| 5,155,915 | A | | 10/1992 | Repa | |
| 5,259,690 | A | | 11/1993 | Legge | |
| 5,325,758 | A | | 7/1994 | Compton et al. | |
| 5,375,361 | A | | 12/1994 | Rustick | |
| 5,377,438 | A | | 1/1995 | Sheinfeld et al. | |
| 5,513,554 | A | | 5/1996 | Paulsson | |
| 5,559,302 | A | | 9/1996 | Latka | |
| 5,574,245 | A | * | 11/1996 | Buc et al. | 102/485 |
| 5,685,102 | A | | 11/1997 | Latka | |
| 5,983,772 | A | | 11/1999 | Reynolds et al. | |
| 6,026,728 | A | | 2/2000 | Gühring et al. | |
| 6,176,032 | B1 | | 1/2001 | Cohen et al. | |
| 6,289,623 | B1 | | 9/2001 | Cohen et al. | |
| 6,412,389 | B2 | * | 7/2002 | Fluhr | 89/14.4 |
| 6,889,593 | B2 | | 5/2005 | Gühring et al. | |
| 6,948,415 | B2 | | 9/2005 | Matthews et al. | |
| 7,290,475 | B2 | | 11/2007 | Fluhr | |
| 7,321,175 | B2 | | 1/2008 | Culpi et al. | |
| 7,594,464 | B2 | | 9/2009 | Dueck | |
| 7,661,349 | B1 | | 2/2010 | Brittingham | |
| 7,676,976 | B2 | | 3/2010 | Dueck et al. | |
| 7,677,150 | B2 | | 3/2010 | Dater et al. | |
| 8,096,073 | B2 | | 1/2012 | Vielbig | |
| 2001/0049996 | A1 | | 12/2001 | Fluhr | |
| 2003/0019352 | A1 | | 1/2003 | Mika | |
| 2005/0115394 | A1 | | 6/2005 | Matthews et al. | |
| 2006/0060076 | A1 | | 3/2006 | Dueck et al. | |
| 2006/0243125 | A1 | | 11/2006 | La France | |
| 2010/0281747 | A1 | * | 11/2010 | Anderson | 42/90 |
| 2010/0313457 | A1 | | 12/2010 | Dueck et al. | |
| 2010/0313743 | A1 | | 12/2010 | Dueck et al. | |
| 2011/0056364 | A1 | | 3/2011 | Kennedy et al. | |
| 2011/0154711 | A1 | | 6/2011 | Dickerson et al. | |
| 2011/0271573 | A1 | | 11/2011 | Vielbig | |

* cited by examiner

BLANK SAFETY DEVICE AND FIREARM ADAPTER

CROSS-REFERENCE TO RELATED APPLICATIONS

This application is a continuation-in-part application of U.S. patent application Ser. No. 12/774,500 entitled "BLANK FIRING ADAPTER FOR FIREARM" filed May 5, 2010, which in turn is a continuation-in-part application of U.S. patent application Ser. No. 12/482,664 entitled "FIREARM ATTACHMENT LOCKING SYSTEM" filed Jun. 11, 2009, now U.S. Pat. No. 8,091,462, all of which are incorporated herein by reference in their entirety. In addition, this application claims the benefit of U.S. Provisional Patent Application No. 61/637,833 entitled "BLANK SAFETY DEVICE AND FIREARM ADAPTER" filed Apr. 24, 2012 which is incorporated herein by reference in its entirety.

BACKGROUND

1. Field of the Invention

The present invention generally relates to firearm attachments and more particularly to adapters for firing blanks.

2. Related Art

Given the danger and cost of using live ammunition, it is common for military and police training to take place using blanks. But the use of blanks is associated with the risk that an operator of a firearm may actually fire real rounds. Firing a live round can cause an extremely perilous situation for the operator of the firearm, people around the person operating the firearm, and in some cases people down range of the firearm in situations such as on a film set where the firearm is to be used as a prop.

Thus, it is conventional to equip the firearm used for blank ammunition training with a blank firing adapter that prevents the user from chambering or firing a live round. In general, when a projectile is passed through the barrel of a firearm, there is a certain amount of back pressure which is utilized in normal operation to operate the action of a rifle such as a semi-asthmatic action and a gas piston system, or in a simple gas system such as in the AR-15. When only a blank is fired, the amount of gas pressure is less without having the accelerating bullet positioned in front of the expanding gas.

Accordingly there is a need in the art for a blank firearm adapter that provides sufficient gas pressure to the firearm during normal usage but prevents fired live rounds from exiting the firearm adapter.

SUMMARY

In accordance with an embodiment, a blank safety device is provided that includes: a body defining a bore having a closed distal end, the body also defining an proximally extending internal cavity in communication with the bore; a bullet plug received within the bore, the bullet plug being configured to distally displace within the bore towards the closed distal end in response to the impact of a fired bullet; and a back section received within the internal cavity in the body, the back section defining an internal chamber that is sealed with respect to a proximal bore for receiving a firearm attachment.

In accordance with another embodiment, a method of indicating to a user that a live round using a blank safety device is provided that includes: attaching the blank safety device to a firearm muzzle, wherein the blank safety device includes a sealed back section at least partially surrounded by an internal cavity in communication with a port that in turn is in communication with an external environment to the blank safety device; and firing a live round through the firearm muzzle into the attached blank safety device, wherein the live round pierces the sealed back section such that a gun blast travels through the internal cavity and through the port to the external environment to alert the user that a live round was fired.

In accordance with another embodiment, a blank safety device is provided that includes: a cylindrical body; and a back section received in the cylindrical body, the back section being hollowed from an open proximal end to a sealed distal end, wherein the open proximal end is configured to receive a firearm muzzle, and wherein the cylindrical body includes a ported internal cavity that at least partially surrounds the sealed distal end of the back section.

The scope of the invention is defined by the claims, which are incorporated into this section by reference. A more complete understanding of embodiments of the present invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE FIGURES

Embodiments of the present invention and their advantages are best understood by referring to the detailed description that follows. It should be appreciated that like reference numerals are used to identify like elements illustrated in one or more of the figures.

DETAILED DESCRIPTION

Figure 1:
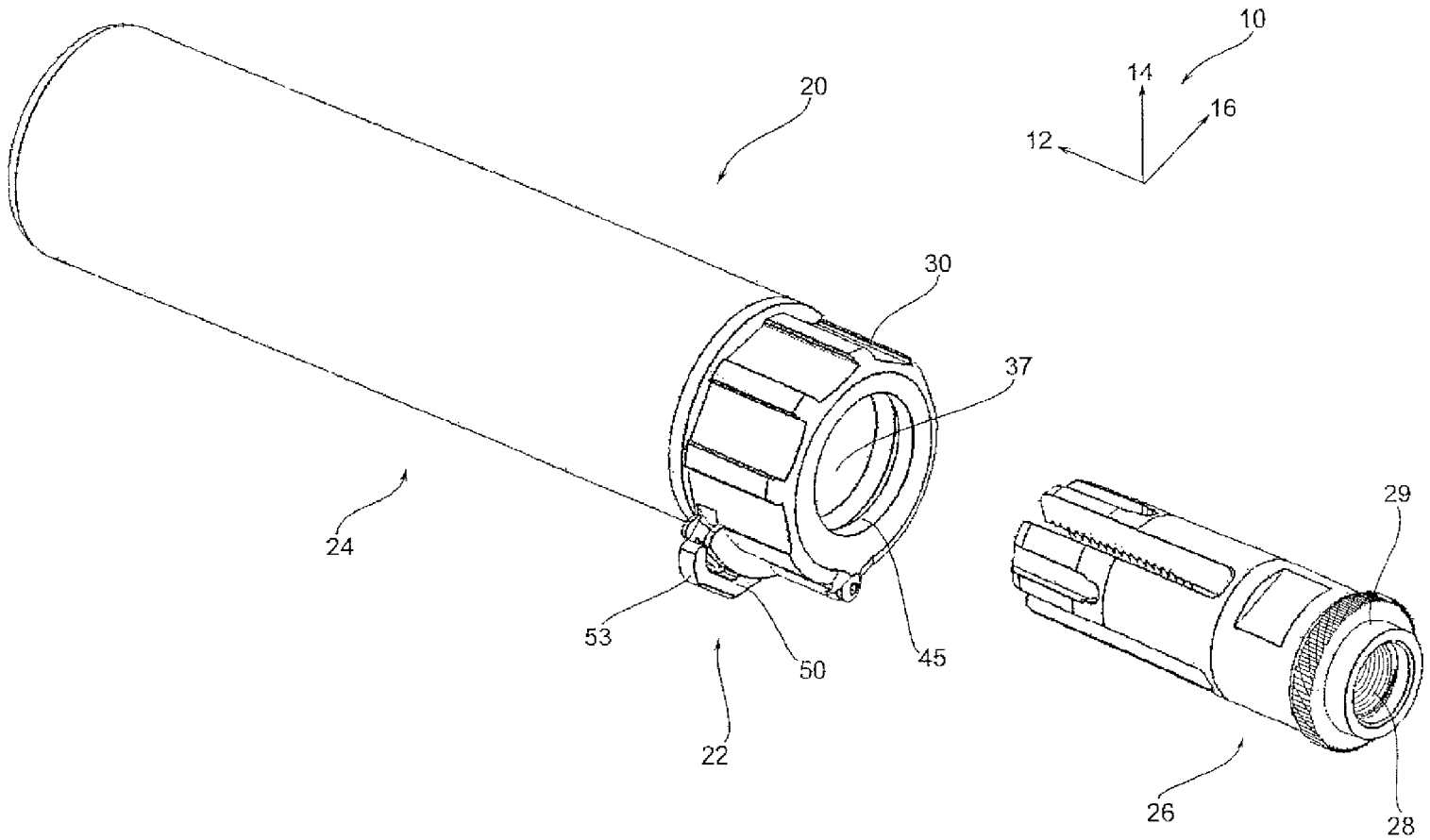
FIG. 1 shows a firearm attachment positioned adjacent to a flash suppressor adapted to be mounted to the muzzle of a firearm in accordance with an embodiment of the invention.

As shown in FIG. 1, there is a firearm attachment 20 such as a suppressor or blank firing adapter which in general comprises a locking assembly 22 and a suppressor or blank firing adapter body 24. As used herein, element 24 will be referred to as "body" 24 for portions of the discussion that are generic to either a suppressor or a blank firing adapter. The firearm attachment 20 is operatively configured to be attached to a muzzle 26 (e.g., a muzzle region or muzzle portion) of a firearm. With regard to such a muzzle region or portion, FIG. 1 generally shows only a muzzle flash suppressor which is configured to be attached to a barrel by way of a threaded portion 28. A Cartesian axes system 10 is defined where an axis 12 defines a longitudinal forward direction, an axis 14 defines a vertical direction, and an axes 16 defines a lateral direction pointing to the right-hand lateral direction by reference of the operator of the firearm. It should be further noted that the axes 14 and 16 both generally indicate a radial direction with reference to the centerline of the suppressor body 24. Further, a tangential direction is defined as a general direction perpendicular the radial direction.

Figure 2:
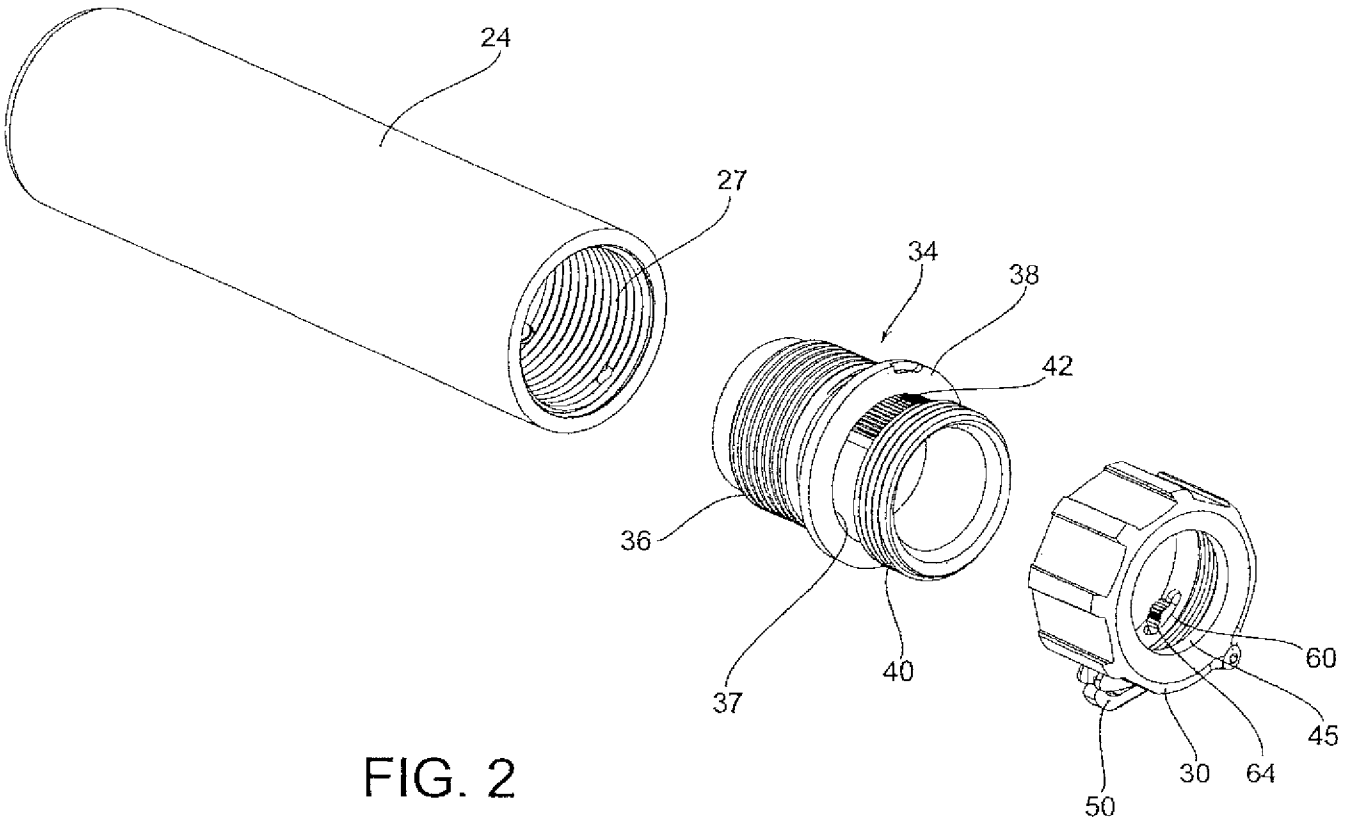
FIG. 2 shows a partially exploded view of a firearm attachment in accordance with an embodiment of the invention.

In general, the locking assembly 22 can be utilized in a variety of embodiments to lock body 24 to a firearm. In one embodiment, the locking assembly 22 comprises a lock ring 30 that is operatively configured to rotate with respect to a base mount 34, which is best shown in FIG. 2 in a partially exploded view. In general, the base mount 34 is provided with a body attachment region 36 which in one embodiment is a threaded cylindrical member configured to attach to a base attachment 27 of body 24 (see FIG. 2). The base mount 34 further comprises a lock ring attachment region 40 which again in one embodiment is operatively configured to be threadedly attached to the lock ring 30. A base flange 38 is provided on the base mount 34 and is interposed between the body attachment region 36 and the lock ring attachment region 40. Positioned adjacent to the base flange 38 is a locking surface 42 which in one embodiment has a plurality of substantially longitudinal extending indentations operatively configured to engage a lock engagement surface 64 on a lock extension 62 of a lock-and-release lever 50 described further herein (see FIG. 4). In general, the locking surface 42 can be formed of a plurality of types of mechanical locking and frictional engagement-type locking surfaces as well as smooth surfaces. The various geometries with respect to the lock engagement surface 64 engaging the locking surface 42 in conjunction with the rotation of the lock ring 30 will be described herein in detail. In general, in one embodiment, the longitudinally extending ridges of the lock engagement surface 64 can either be used directly upon base mount 34 or upon a muzzle portion or directly upon a firearm.

Figure 3:
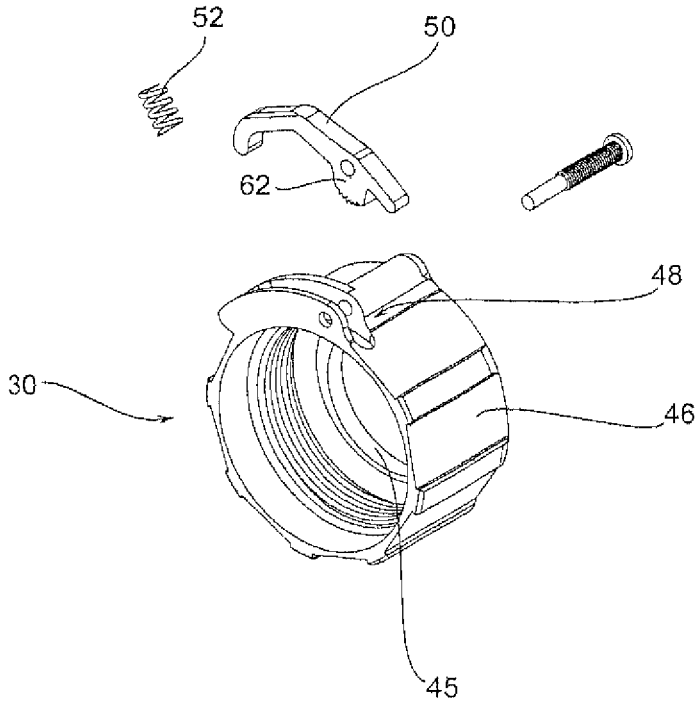
FIG. 3 shows an exploded view of a lock ring configured to be a portion of the firearm attachment in accordance with an embodiment of the invention.
Figure 4:
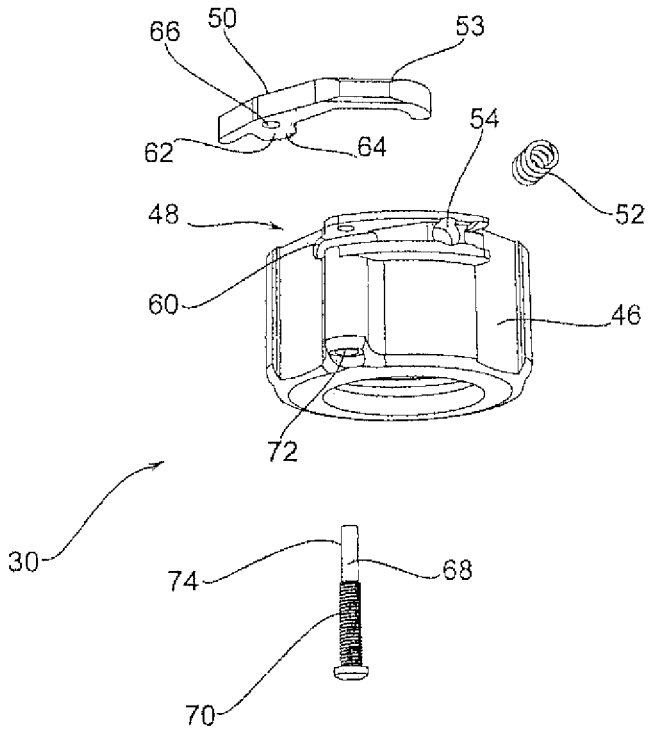
FIG. 4 shows another exploded view of a lock ring taken from a vantage point looking upon the fastener housing of the lock ring in accordance with an embodiment of the invention.

The lock ring 30 is shown in an exploded view in FIGS. 3 and 4. In general, the lock ring 30 comprises a base ring 46 having a locking region 48. The locking region 48 is configured to have the lock-and-release lever 50 in one embodiment pivotally mounted thereto. FIG. 4 is an isometric view of the locking region 48 where it can be seen that a biasing member 52 such as a helical spring may be configured to be fit within the surface defining a biasing member base 54. The biasing member base 54 may be an indentation roughly the diameter of the biasing member 52 so as to fit the biasing member 52 therein to be interposed between the lock-and-release lever 50 and the base ring 46.

The base ring 46 further comprises, in one embodiment, a surface defining a lock opening 60 which is configured to allow the lock extension 62 of the lock lever to extend therethrough as shown, for example, in FIG. 2 in the lower right-hand portion. In general, the lock extension 62 includes the lock engagement surface 64, which is operatively configured to engage the locking surface 42 as described further herein. The lock-and-release lever 50, in one embodiment, is pivotally attached at a pivot attachment location 66, which is operatively configured to receive a fastener 68 (see FIG. 4). In general, the fastener 68 can be arranged in a plurality of embodiments, but in one embodiment, a threaded portion 70 can be received within a fastener housing 72 of the base ring 46 so that an extension 74 extends through the attachment location 66 of the lock-and-release lever 50.

Figure 5:
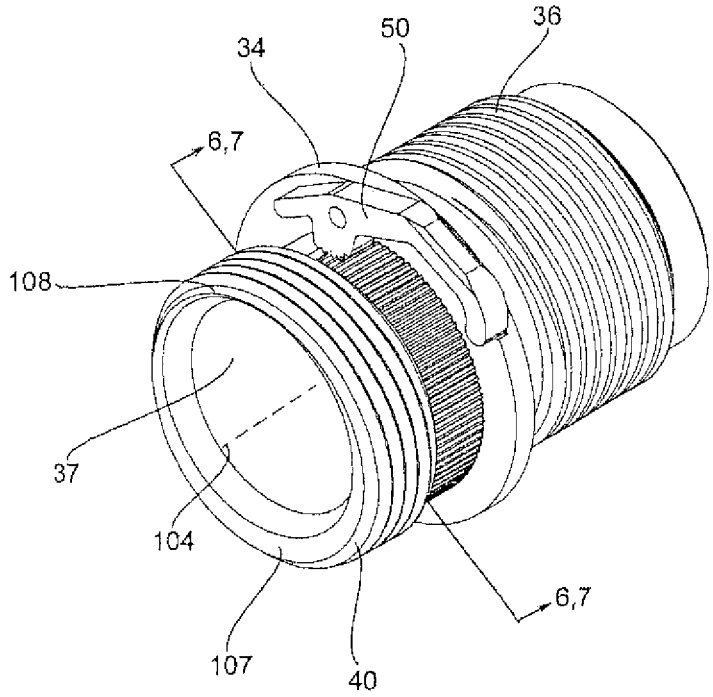
FIG. 5 shows a partial component view of the lock ring only showing the lock-and-release lever positioned in an engaged position with the lock surface of the base body, and is shown for illustrative purposes of describing the mechanism where in operation, the lock-and-release lever would be pivotally attached to the lock ring which in turn is attached to the base body in accordance with an embodiment of the invention.
Figure 6:
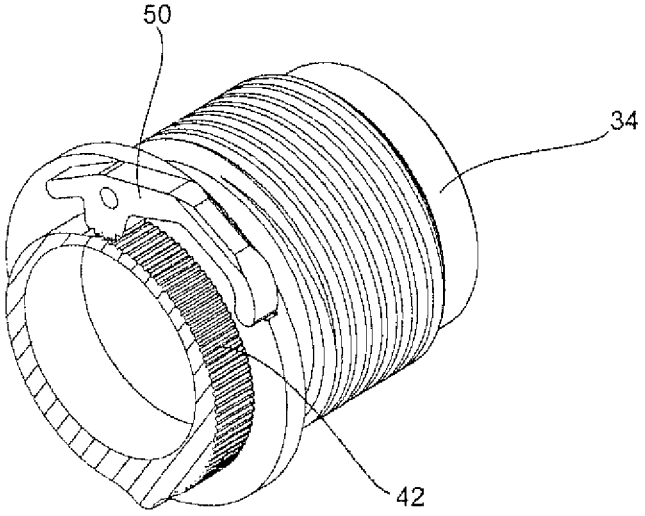
FIG. 6 shows the base body in a sectional view whereby the lock ring attachment region which is threaded is thereby removed from view in accordance with an embodiment of the invention.

To further explain the dynamics of the lock engagement surface 64, the lock-and-release lever 50, the base mount 34, and in particular the locking surface 42, reference is now made to the isometric view in FIG. 5, which shows the base mount 34 with respect to the lock-and-release lever 50 (with the base ring 46 cutaway) when the lock lever is arranged in a locking orientation. It should be reiterated that the lock-and-release lever 50, in practice, is assembled to the base ring 46 to form a complete unit, as shown in FIG. 2. However, for purposes of explanation of the geometries, to simplify the discussion of FIG. 5 and also for FIGS. 7A-7G, the related structural components are not shown for purposes of simplicity of explanation. FIG. 5 shows the isometric view of the base mount 34 and the locking lever 50, where the cut line 6,7-6,7 provides a cut plane having a perpendicular axis in the longitudinal direction. FIG. 6 shows a sectional view where the lock ring attachment region 40 having the threaded portion of a larger diameter in one embodiment is not shown. Now referring to FIG. 7A, it can be seen that there is a front view taken along the cut line 6,7-6,7 of FIG. 5, illustrating in detail the geometric relationship of the lock-and-release lever 50 and the locking surface 42 of the base mount 34. In general, the lock lever is provided with the biasing member 52, as shown in FIG. 3, to provide a torquing force upon the lock lever indicated by the vector 71 (see FIG. 7A). Of course, in the broader scope, a plurality of rotational forces can be applied upon the lock-and-release lever 50 in various configurations. A rotational torque on the lock-and-release lever 50 is one operational element to provide forceful engagement between the lock engagement surface 64 and the locking surface 42.

Figure 8:
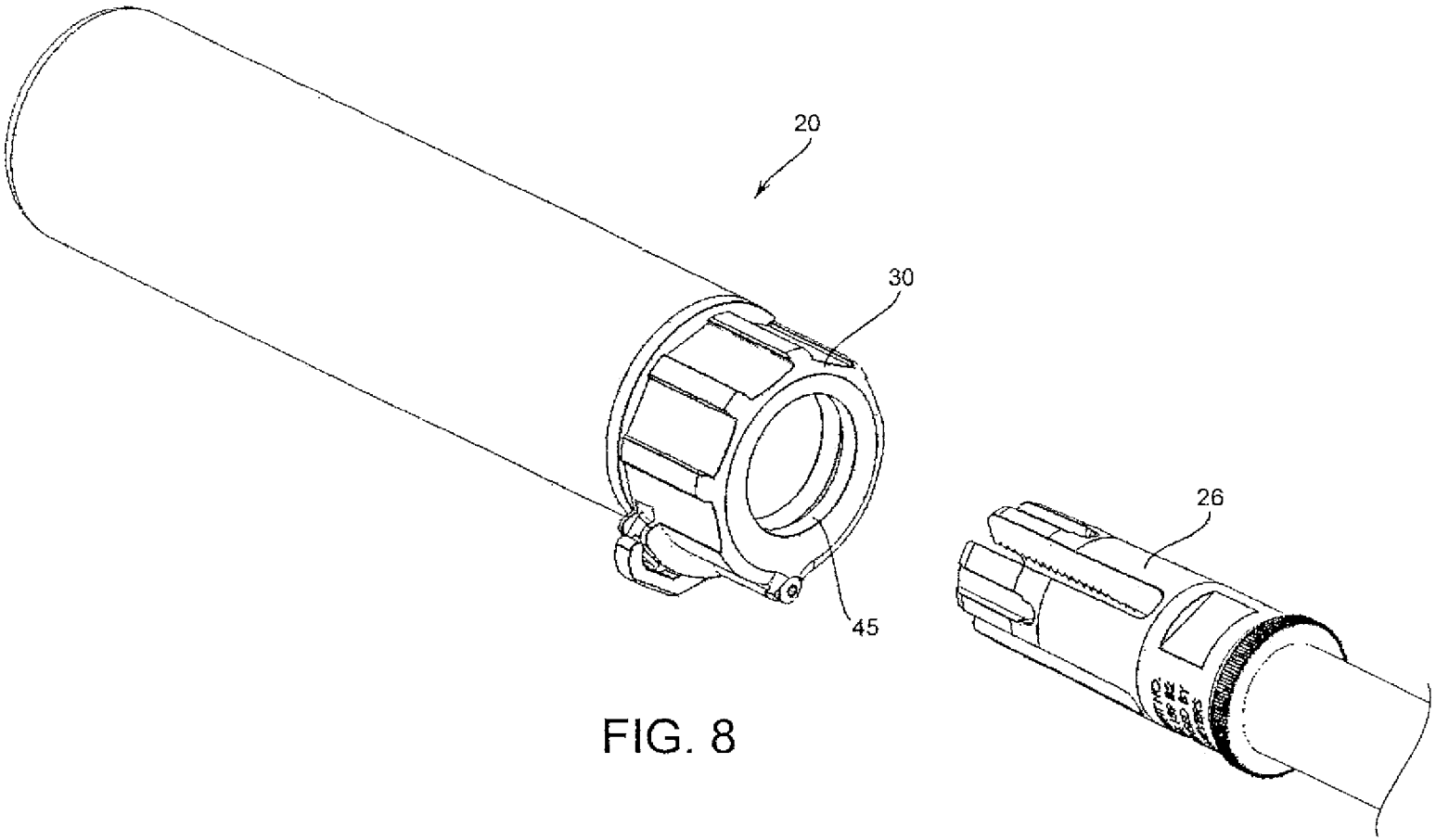
FIG. 8 shows the firearm attachment in an unlocked orientation positioned adjacent to the muzzle of a firearm in accordance with an embodiment of the invention.
Figure 9:
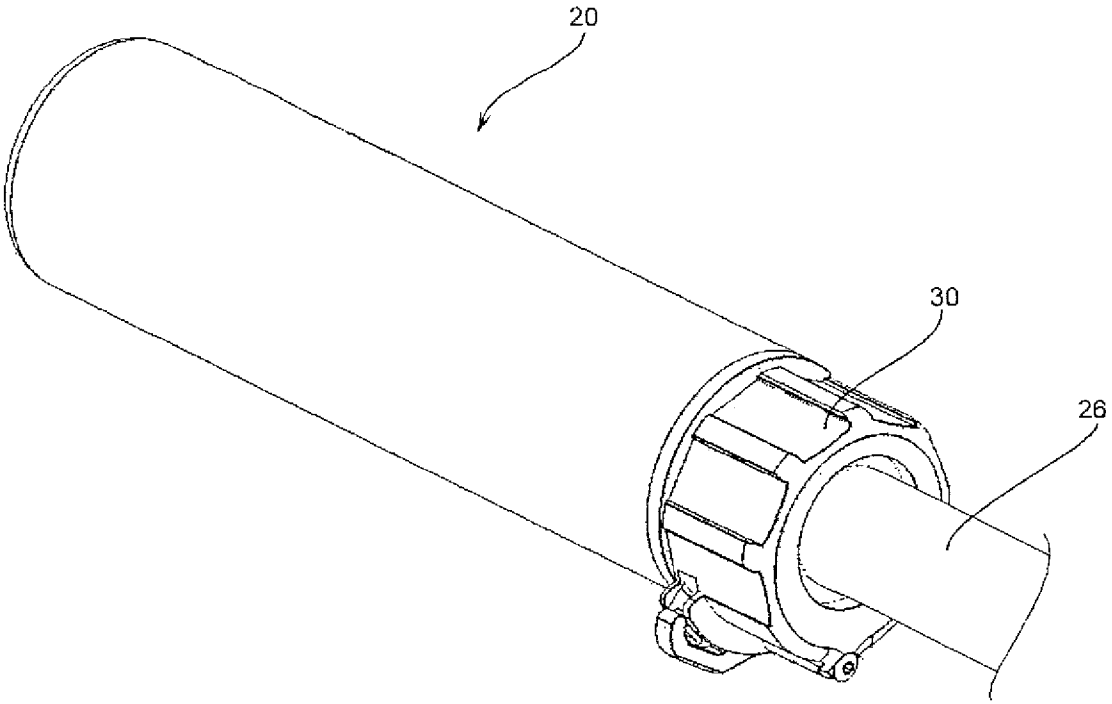
FIG. 9 shows the muzzle inserted into the firearm attachment with the lock ring in an unlocked orientation in accordance with an embodiment of the invention.
Figure 10:
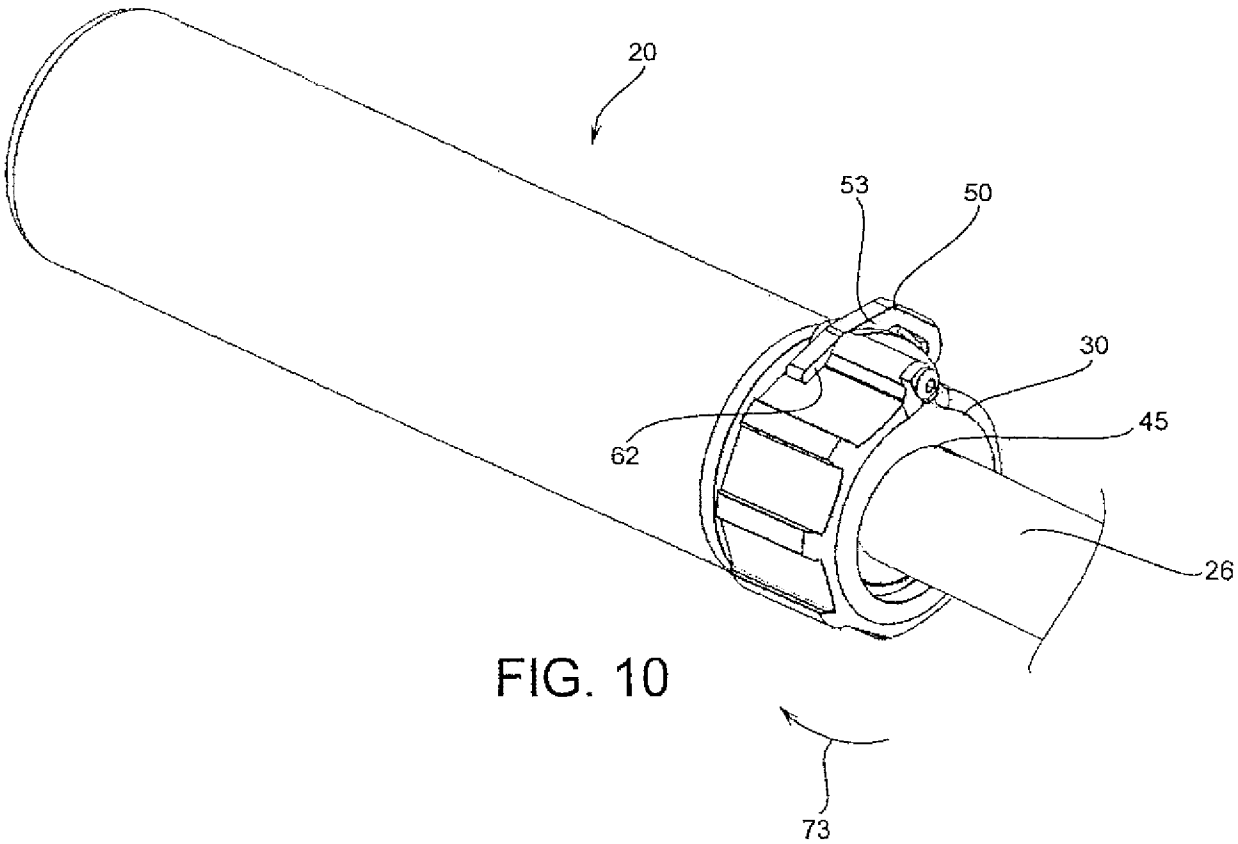
FIG. 10 shows a lock ring rotated into a locked orientation in accordance with an embodiment of the invention.

Before further describing the dynamics of the geometries, orientations, and arrangement of the surfaces, there will first be an overview of the locking operation with reference to FIGS. 8-11. As shown in FIG. 8, the firearm attachment 20 is shown in an isometric view positioned adjacent to the muzzle 26 of a firearm. It should be noted that the orientation of FIG. 8 is an unlocked orientation of the locking assembly 22 (shown in FIG. 1). The unlocked orientation is where the lock ring 30 is rotated counterclockwise (in one embodiment) such that a non-concentric engagement surface 45 (shown also in FIG. 3) is in substantial alignment with an inner surface 37 of base mount 34 (FIG. 2). Now referring to FIG. 9, it can be seen that the muzzle 26 is inserted into the body 20. Finally, FIG. 10 shows the lock ring 30 rotated counterclockwise from the perspective of the operator of the firearm (or, of course, the lock ring could be rotated clockwise with a symmetrically opposite arrangement). It can generally be seen that the non-concentric engagement surface 45 is now in tight frictional engagement with the muzzle 26 so as to rigidly attach to the suppressor 20 thereto. In one embodiment, the frictional engagement of the non-concentric engagement surface 45 is such that experimentation has found that the suppressor will be rigidly mounted to the muzzle of a firearm given the geometries of the non-concentric engagement surface 45 described further herein. However, the lock-and-release lever 50 provides a secure engagement so as to ensure that the suppressor 20 is not removed from the firearm unless a release 53 of the lock-and-release lever 50 is pressed.

Referring back to FIG. 7A, it can be appreciated that, when in the locked orientation, the lock engagement surface 64 of the lock-and-release lever 50 in one embodiment is provided with a plurality of engagement teeth 80, which can generally have the dimensions and properties of a knurled surface. In general, the plurality of engagement teeth 80 has a force engagement region 82 shown in FIG. 7A having a center of force generally indicated by the force vector 84. Therefore, it can be appreciated that the center of force vector 84 is positioned in the left-hand portion of the radial reference line 86. In other words, as the vector 71, which indicates the force of the biasing member 52 creating a moment upon the lever 50, forcefully engages the plurality of engagement teeth 80 upon the force engagement region 82, this force engagement region will not pass the radial reference line 86 so as to reduce the effect of the locking engagement between the lock engagement surface 64 and the locking surface 42 (the locking force between the lock ring 30 and the base mount 34).

Figure 7A:
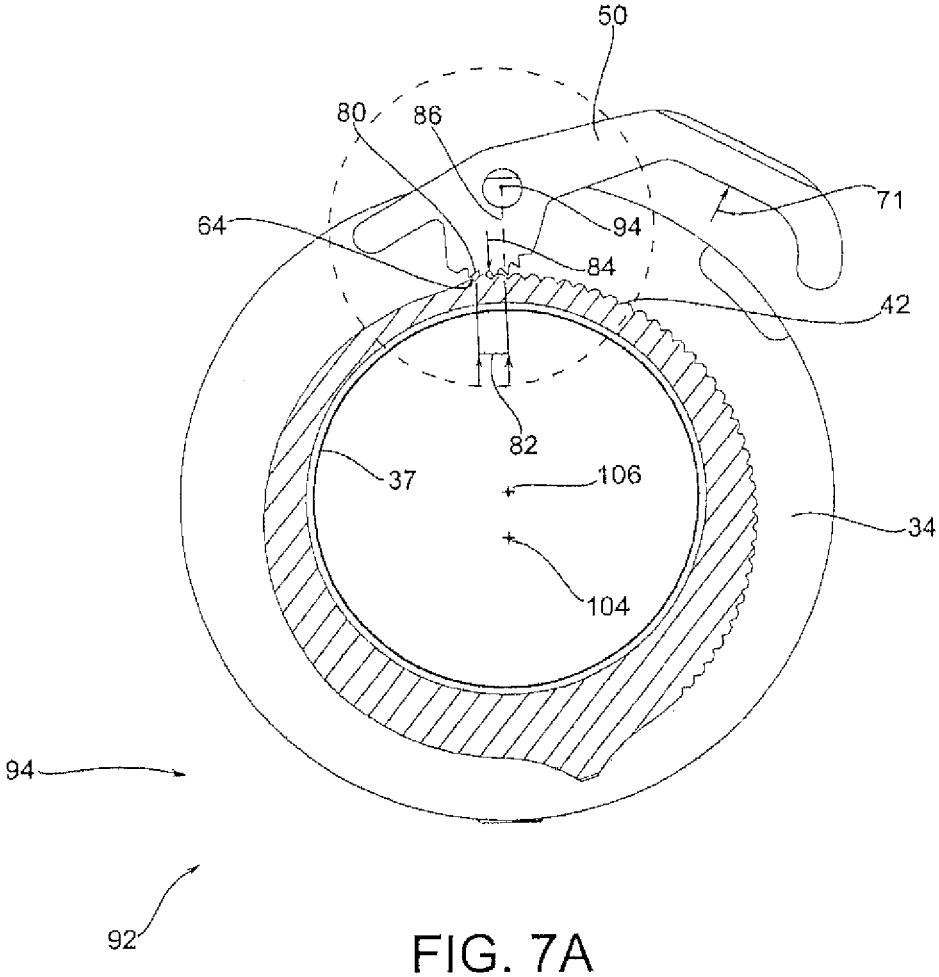
FIG. 7A is taken along line 6,7-6,7 of FIG. 5 where the engagement between the base body and the lock-and-release lever can be seen in accordance with an embodiment of the invention.
Figure 7B:
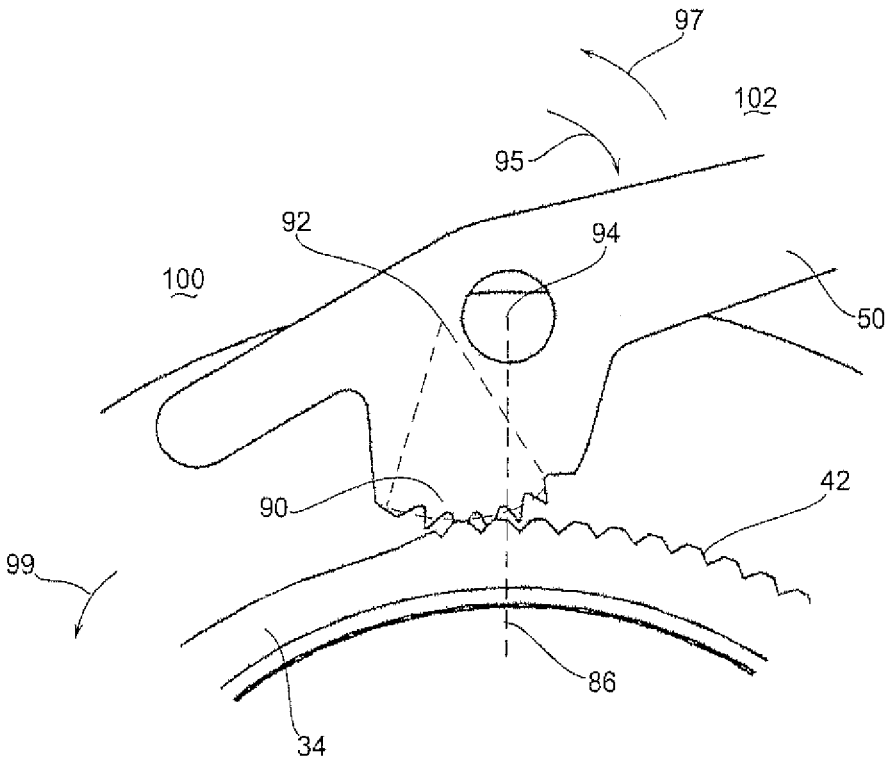
FIG. 7B shows a close-up view of the lock-and-release lever, and more specifically an engagement of the lock engagement surface and the locking surface of the base body in accordance with an embodiment of the invention.

It should further be noted, as shown in FIG. 7B showing a close-up view of the plurality of engagement teeth, that the reference arc 90 generally has a center 92 that is non-concentric with the pivot mount providing a center of rotation 94 of the lock-and-release lever 50. As the lock lever rotates in a lock rotation 97 about the center of rotation 94, the lock engagement surface 64 is in greater forceful engagement with the locking surface 42. When the lock-and-release lever 50 is rotated in an unlock rotation 95, the surface 64 disengages to allow the lock ring 30 to rotate in an unlock direction 99. More specifically, the center 92 of the reference arc 90 is positioned in the same region as the center of force vector 84 with respect to the radial reference line 86. To aid in the description of the orientation of the rotation points and surface engagement regions, a region 100 is orientated in FIG. 7B to the left lower region of the radial reference line 86. The region 100 is defined as the lock maintenance region. An opposing region 102 (FIG. 7C) which is shown in the right-hand portion of the radial reference line 86 is referred to as the unlock region. The radial reference line 86 is defined as the radially extending line intersecting the center of rotation 94 of the lock-and-release lever 50 to the center of rotation 104 of the lock ring as shown in FIG. 7A. In general, the center rotation 104 of the lock ring is the center of the lock ring attachment region 40 such as that shown in FIG. 5. It should be noted that a center longitudinal axis 106 of the muzzle as best shown in FIG. 7A is positioned above or otherwise offset from the center of rotation 104 of the lock ring. Of course, in one embodiment, the center longitudinal axis is positioned thereabove, but in other embodiments needs to be offset in a radial direction. The center longitudinal axis 106 is, in general, the geometric center of the muzzle. As seen in FIG. 5 the lock ring attachment region 40 is provided with threads rotating about the center of rotation 104 of the lock ring. These threads are generally offset from threads providing the body attachment region 36. In other words, as shown in FIG. 5, a region 107 is thicker in the radial direction than a diametrically opposed region 108. Of course referring back to FIG. 2, it can further be appreciated that the lock ring is provided with the engagement surface 45 that is not concentric with a base mount attachment surface, which in one embodiment is a threaded region to be threadedly attached to the lock ring attachment region 40 of the base mount 34.

Figure 7C:
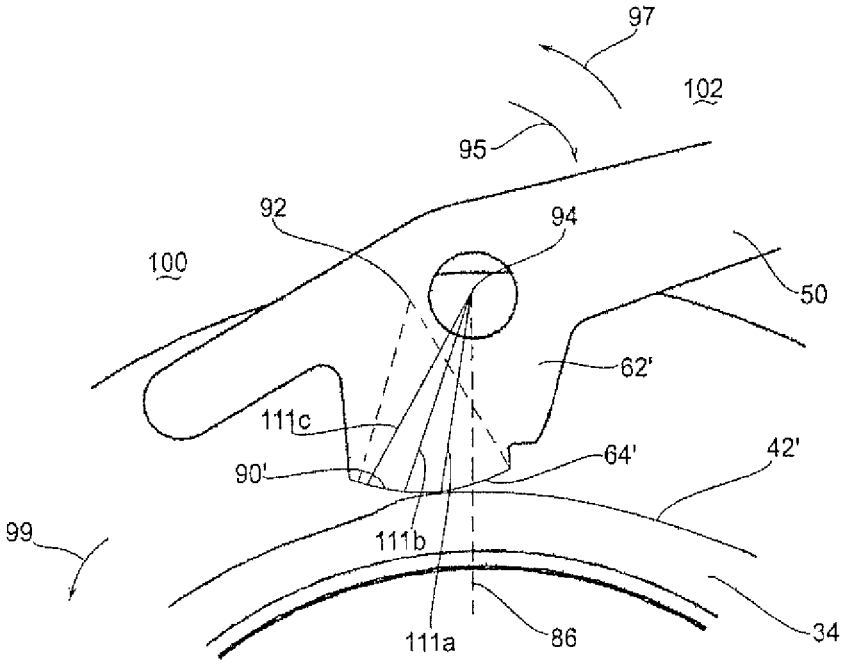
FIG. 7C shows another embodiment where the locking surface and the lock engagement surface are a substantially smooth surface, and shows various distant vectors illustrating a geometric relationship between these two surfaces in accordance with an embodiment of the invention.

Now referring to FIG. 7C there is shown another embodiment where a base reference arc 90' is coincident with a lock engagement surface 64'. Further, a locking surface 42' is now shown as a surface in one embodiment without ridges. In general, when the locking ring is subjected to various external forces and vibrations to rotate the locking ring in an unlocked rotation indicated at the rotational vector 99, the frictional engagement between a lock extension 62' and the locking surface 42' is geometrically arranged as such to inhibit rotation unless the lock-and-release lever is pressed to disengage from the locking surface 42'. The center of a base reference arc 92 is positioned in the lock maintenance region 100 which is the lateral region indicated in FIG. 7C from a plane defined by radial reference line 86 and the longitudinal axis. FIG. 7C further shows another way of defining the base reference arc where a set of distance reference vectors 111*a*, 111*b*, and 111*c* are arranged so as to increase in length as these vectors advance toward the lock maintenance region 100. For purposes of disclosure, the distance reference vectors 111*a*, 111*b*, and 111*c* are to scale with respect to one another in one embodiment to properly maintain the lock ring in a locked orientation. In other words, as the lock-and-release lever 50 rotates in the lock rotation 97, the distance between a forceful engagement between the surfaces 64' and 42' and the center of rotation 94 increases, thereby causing more force to be exerted between the lock-and-release lever 50 and the base mount 34.

Figure 7D:
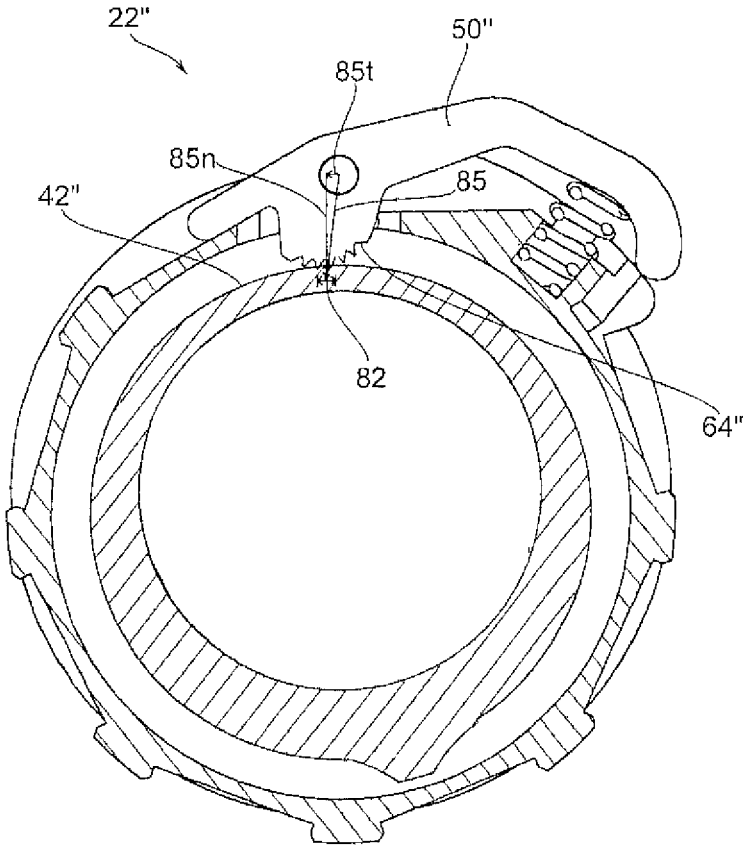
FIG. 7D shows another embodiment of an arrangement of surfaces between the lock engagement surface of the lock extension and the locking surface of the base body in accordance with an embodiment of the invention.

Now referring to FIG. 7D there is shown another embodiment of carrying out a locking assembly 22". As shown in FIG. 7B, a locking lever 50" is substantially similar to the locking lever as shown in, for example, FIG. 7A. FIG. 7D shows a locking surface 42" which in this embodiment is substantially smooth or otherwise provides fewer indentations than the locking surface 42 shown in FIG. 7A. With the correct geometries established between the locking lever 50' and the locking surface 42", a locked engagement can be provided where it can be appreciated that the amount of force exerted upon the locking surface 42" by the locking release lever 50" is indicated by the force vector 85. In general, the vector 85 is comprised of the vector components 85*n* and 85*t* to represent the normal and tangential components. As shown in FIG. 7D, the angle of vector 85*n* with respect to the vector 85 is approximately 10°. The ratios of normal component 85*n* and an orthogonal tangential component 85*t* where the ratio of force values between the normal component to the tangential component is at least 5:1 or greater such as 10:1 and 20:1. In a broader range this angle can be between 2° and 25°. Other ranges and/or ratios may be used in other embodiments. In general, the distribution of force of the vector 85 is located in the force engagement region 82 in a similar manner as discussed above with reference to FIG. 7A. Of course there is a certain amount of surface area engaging between the surfaces 64" and 42".

Figure 7E:
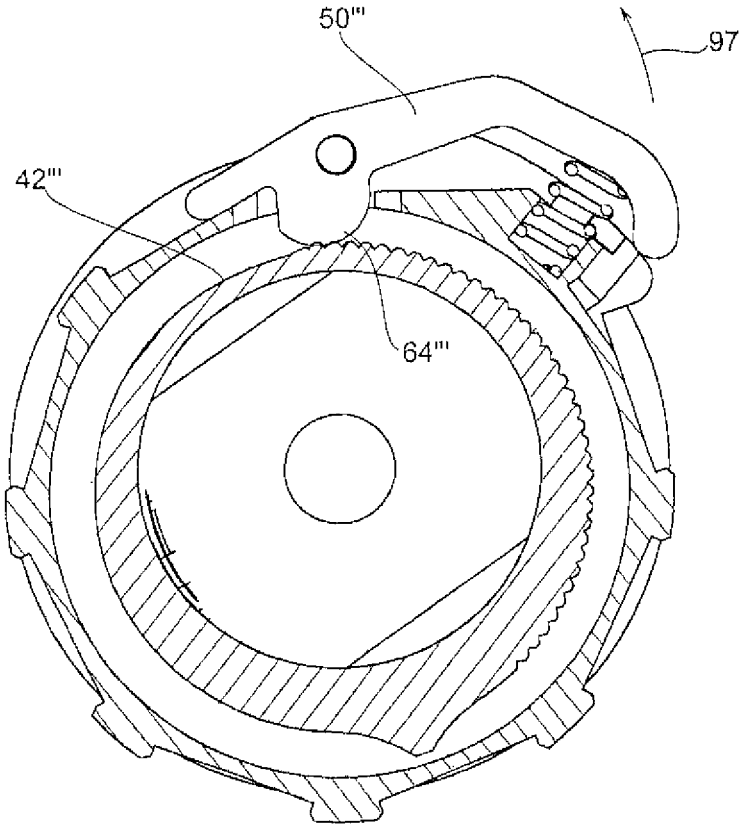
FIG. 7E shows another embodiment of different surface contours between the two main locking surfaces in accordance with an embodiment of the invention.

Now referring to FIG. 7E there is shown a locking release lever 50'" which comprises a locked engagement surface 64'" which is substantially smooth. The surface 64'" is basically coincident with a base reference arc 90 as described above in FIG. 7B. It can generally be seen how the lock rotation direction 97 would provide greater forceful engagement between the surfaces 64'" and 42'".

Figure 7F:
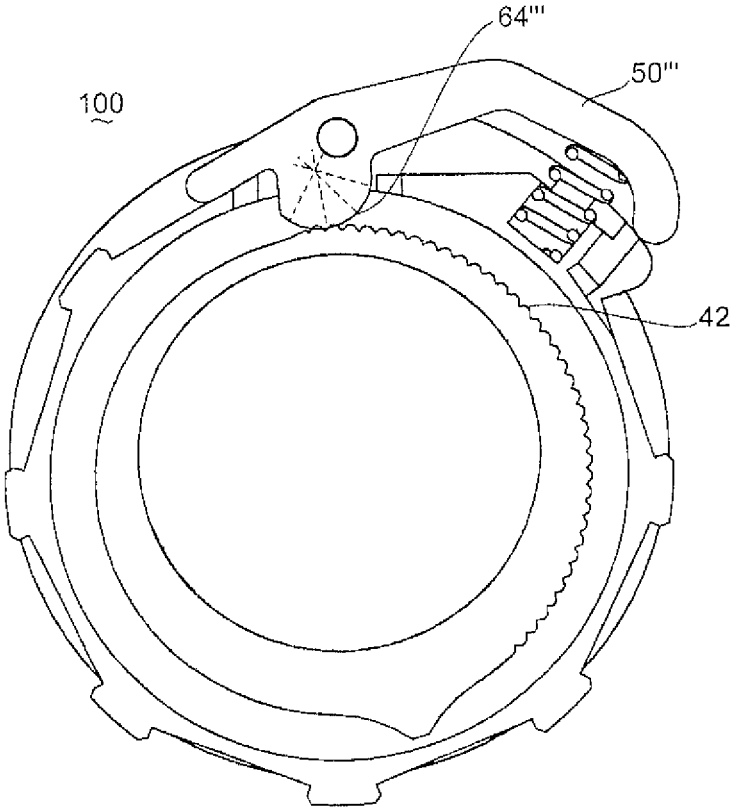
FIG. 7F shows another embodiment of an arrangement of a lock engagement surface of the lock-and-release lever in accordance with an embodiment of the invention.

Now referring to FIG. 7F, there is shown yet another variation where the locking engagement surface 64'" is similar to that shown in FIG. 7E, and the locking surface 42 is similar to that shown in FIG. 7A. In general, a plurality of types of engagement surfaces can be employed. In one embodiment, the relationship between the surfaces generally shown as 42 and 64 (with various suffix indicators to illustrate different embodiments and variations) can be arranged. As noted above, the various surfaces with the prefix reference numeral 64 can have a center arc that is generally orientated in the lock maintenance region 100. FIG. 7F shows various hashed reference lines indicating the normal component of the surface 64'" in one embodiment. Alternatively, as shown in FIG. 7C, the vectors 111 can increase in length (progressing from a greater length from 111*a* to 111*b* and a greater length from 111*b* to 111*c*, etc.). The rate of increase of these vectors can be between 2.5%-6% per 10 degrees of rotation from the center of rotation 94 relative to the diameter of the locking surface 42. Other rates of increase may be used in other embodiments. The coefficient of friction between the surfaces 64' and 42' has an effect upon the angle between the radial reference line 86 (FIGS. 7B and 7C) and the effect of contact between the surfaces 64' and 42' which is generally indicated at vector 111*a* which is approximately 10°. Other angles may be used in other embodiments. In one embodiment, the various images in the figures are proportional to scale. In general, the embodiment as shown in FIG. 7C can operate where effectively the surfaces 64' and 42' are smooth. As the lock ring tightens, it is preferable to not have any backing out of the lock ring (or firearm attachment in the embodiment in FIG. 27) whereby providing teeth and a larger angle of approximately 45° between the pivot point 94 and the engagement of the surface 64' would be too great of an angle and engagement teeth would be necessary. Other angles may be used in other embodiments. The greater the size of the teeth the more potential for having the lock ring "back out" to fit the closest sized engagement of teeth members. If the teeth are finer to provide finer adjustment, they are more susceptible to failure by way of introducing material between the teeth such as dirt, corrosion or otherwise failure by way of shear stress.

Figure 7G:
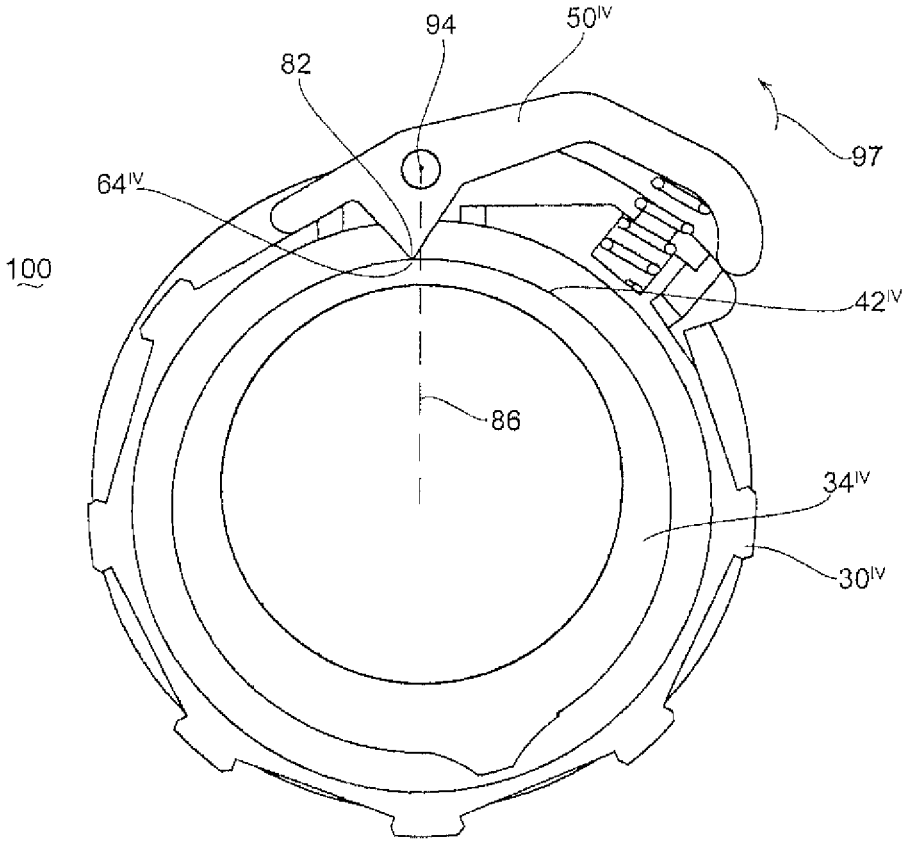
FIG. 7G shows another embodiment of a lock engagement surface having a finer point of contact which can be utilized in accordance with an embodiment of the invention.

Now referring to FIG. 7G there is shown yet another embodiment of a lock-and-release lever 50 IV, where in this embodiment a locking engagement surface 64IV is arranged as more of a point. In this embodiment, the engagement of the pointed portion at surface 64IV to the locking surface 42 IV is located in the lock maintenance region 100 (to the first lateral portion of the plane defined by the radial reference line 86 and the longitudinal axis). In this embodiment, it can be appreciated that as the lock lever 50IV rotates in the lock rotation direction 97, the point of contact between the lock lever and the base mount 34IV will provide forceful engagement to maintain the lock ring 30IV locked in place. Therefore, the embodiment in FIG. 7G basically shows a force engagement region 82 which is much smaller in tangential distance than that shown in, for example, FIG. 7A or FIG. 7D. Therefore, one embodiment of defining the engagement is to provide the central portion of the force engagement region to be positioned so as to not rotate past top dead center of the center of rotation 94 of the lock-and-release lever 50IV. In one embodiment, the angle from the radial reference line to the center of the force engagement region 82 is based from the center of rotation point 94 and is less than 10°, and in a broader range this value is less than 2° to 25°. In one embodiment, the range is approximately 7° plus or minus 20 percent. Other angles and/or ranges may be used in other embodiments.

Figure 11:
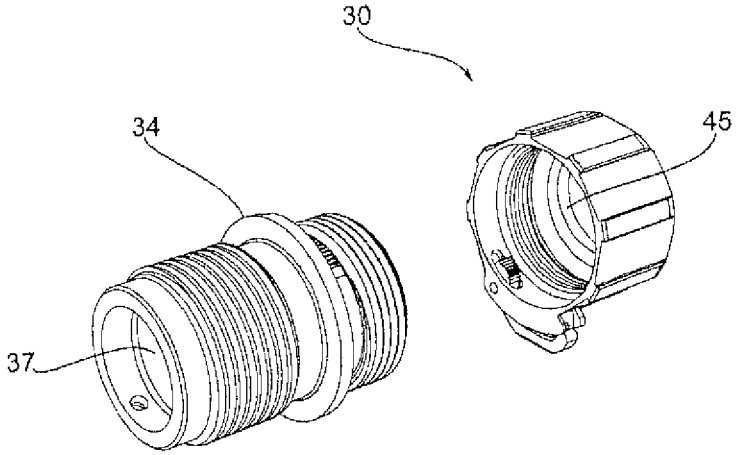
FIG. 11 shows the lock ring disengaged from the base body showing a rotating lock member in accordance with an embodiment of the invention.
Figure 12:
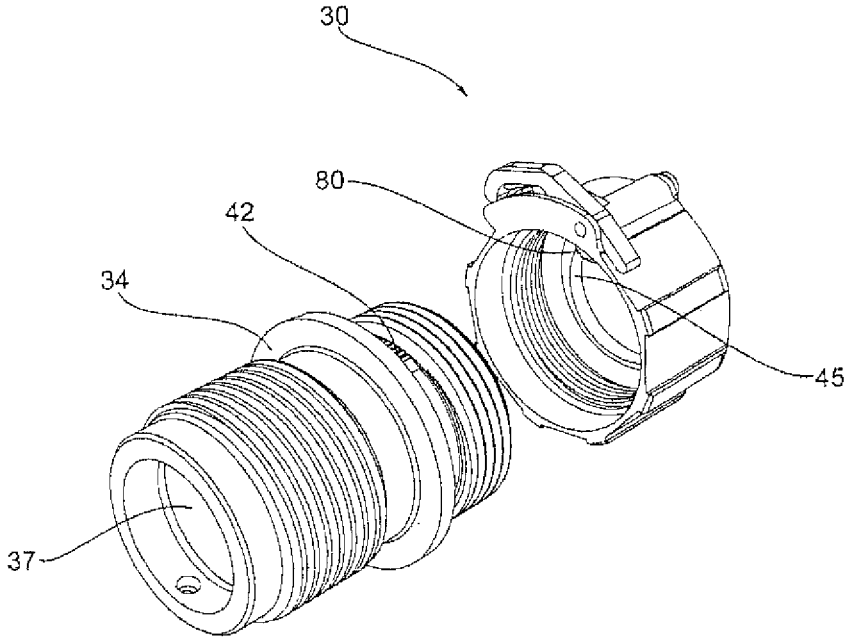
FIG. 12 shows a lock ring still positioned in an exploded view with respect to the base body, except the lock ring is now rotated into a locking orientation along the central longitudinal mutual axis between the lock ring and the base body in accordance with an embodiment of the invention.

FIG. 11 shows the locking ring 30 in an exploded view with respect to the base mount 34. In general, it can be appreciated that, in this orientation, the non-concentric engagement surface 45 of the lock ring is in substantial alignment with the cylindrical surface 37 of the base mount 34. In other words, the central axes of the surfaces 45 and 37 are substantially co-linear, and the cylindrical surfaces 37 and 45 (cylindrical in one embodiment) are of substantially the same diameter. Now referring to FIG. 12, it can be seen that the lock ring 30 is now rotated substantially 180° or a lesser amount of rotation than 180° in one embodiment, and it can be appreciated that the non-concentric engagement surface 45 is now in one embodiment still parallel to the central axis of the cylindrical surface 37 of the base mount 34, but is offset in this case in the vertically downward direction (but in general offset in any radial direction). Other angles may be used in other embodiments. It further can be noted in FIG. 12 that if the components 30 and 34 were assembled, the plurality of engagement teeth 80 would now be in engagement with the locking surface 42.

Figure 13:
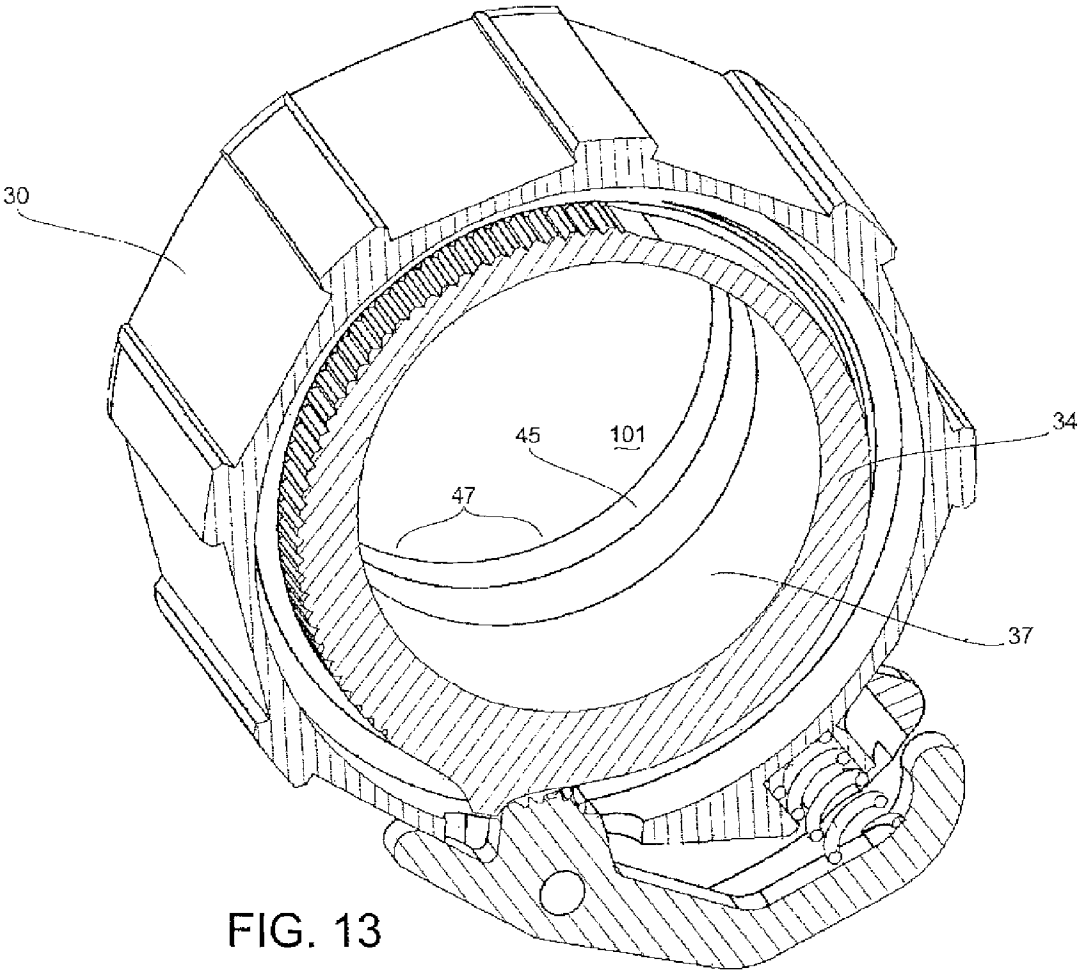
FIG. 13 shows an isometric sectional view of the lock ring engaging the base body in accordance with an embodiment of the invention.
Figure 14:
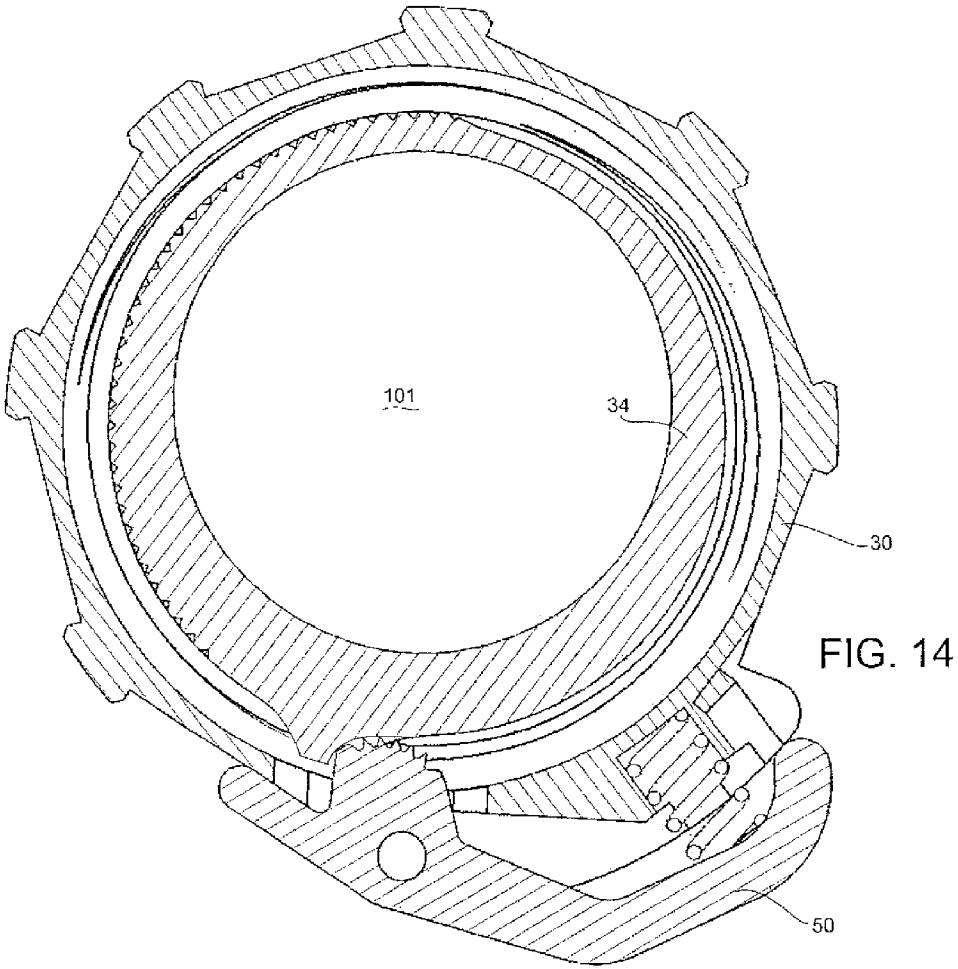
FIG. 14 shows a similar orientation of components of FIG. 13, except in a view taken along the longitudinal axis where the central open area is arranged to have a muzzle pass therethrough and the components are in an unlocked orientation in accordance with an embodiment of the invention.
Figure 15:
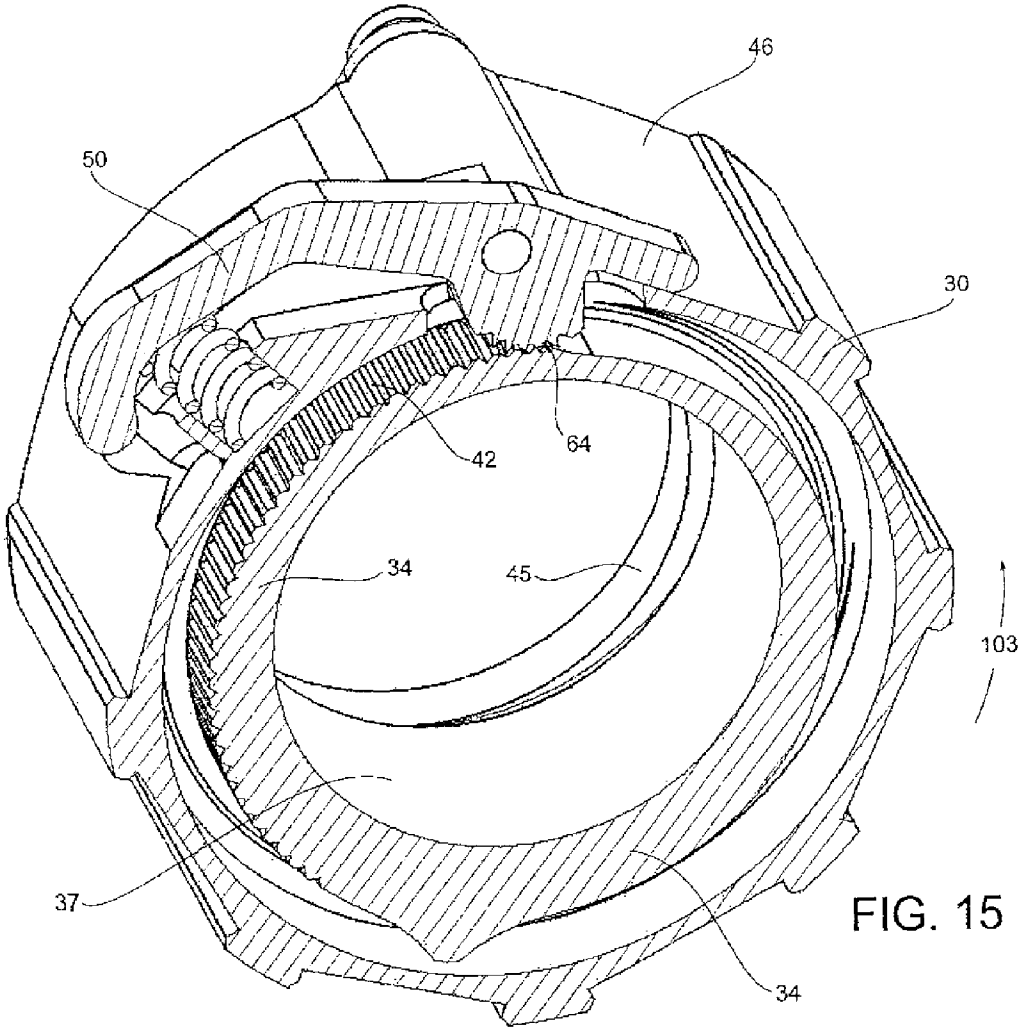
FIG. 15 is a sectional isometric view similar to that of FIG. 13 except the lock ring is now positioned in a locked orientation with respect to the base body in accordance with an embodiment of the invention.
Figure 16:
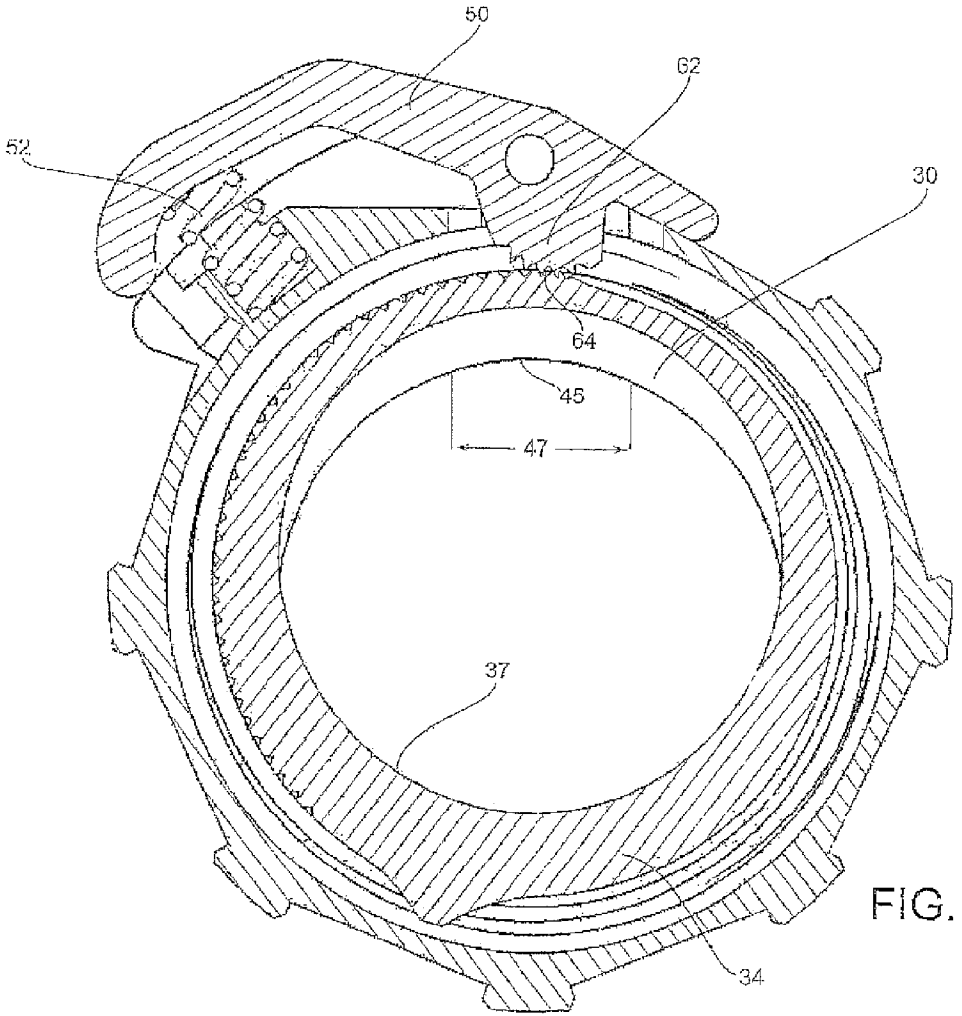
FIG. 16 is a view of the orientation of components in FIG. 15 except taken along the longitudinal axis where it can be seen that the non-concentric engagement surface is repositioned in the manner so as to forcefully engage the muzzle of a firearm, which can be the barrel or the muzzle attachment such as a flash suppressor or any other end portion of the muzzle region of the firearm in accordance with an embodiment of the invention.

FIG. 13 further shows a sectional view of the base mount 34 in cross-section showing that the inner surface 37 of the base mount is substantially in-line with the non-concentric engagement surface 45 of the lock ring 30. FIG. 14 shows the sectional view in a non-isometric format directly along the longitudinal axis, illustrating a central open area 101, which is generally defined between the surfaces 37 and 45 of FIG. 13. It can be appreciated that the outer substantially conical surface of the muzzle 26 as shown in FIG. 1 is operatively configured to fit within the central open area 101. Now referring to the isometric view of FIG. 15, it can be appreciated that the lock ring 30 is rotated in the direction indicated by a rotational vector 103 so that the lock engagement surface 64 engages with the locking surface 42 of the base mount 34. As can be generally seen in FIG. 15, the non-concentric engagement surface 45 of the lock ring 30 and more particularly the solid unitary structure of the base ring 46 is now repositioned so as to no longer be in alignment with the inner surface 37 of the base mount 34. As better shown in FIG. 16, it can be seen that the non-concentric engagement surface 45 is now offset from the inner surface 37 of the base mount 34. More specifically, a muzzle engagement region 47 as shown in FIG. 16 is a portion of the non-concentric engagement surface 45, which is in forceful engagement with the outer surface of the muzzle (which broadly includes the barrel, a flash suppressor or any portion of the gun itself), and more particularly in engagement at a lock surface region 29 as shown in FIG. 1. Further, the opposing surface region upon the inner surface 37 of the base mount 34 has the more longitudinally forward and lower region of the muzzle forcefully engaged therewith to provide a lock between the body 20 and the muzzle 26 of the firearm (see FIG. 1).

Figure 17:
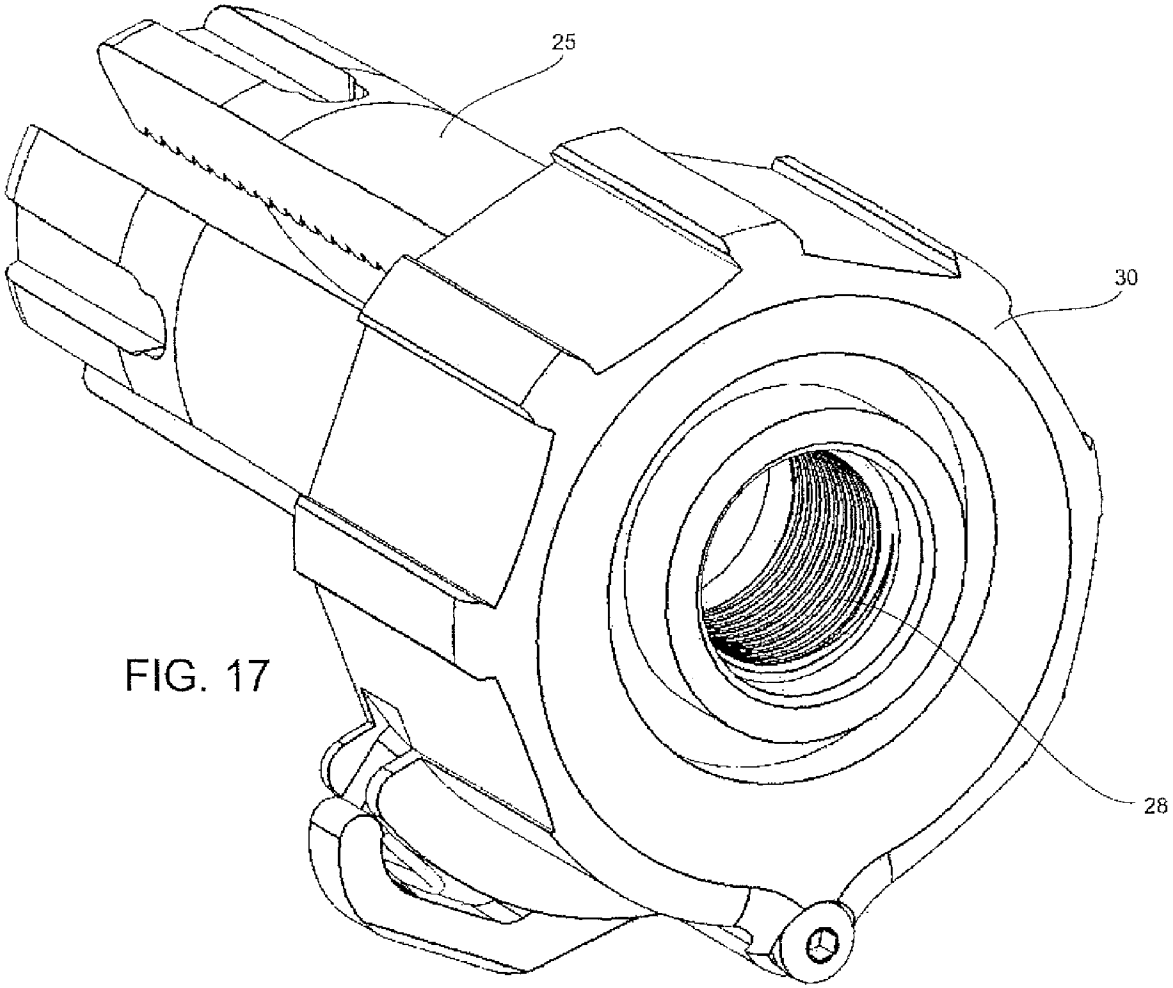
FIG. 17 shows a portion of a muzzle which is a threaded flash suppressor positioned in the lock ring where it can generally be seen that the lock ring is positioned in the unlocked orientation and the front central opening of the locking having a center axis is substantially co-linear with the central axis of the muzzle in accordance with an embodiment of the invention.
Figure 18:
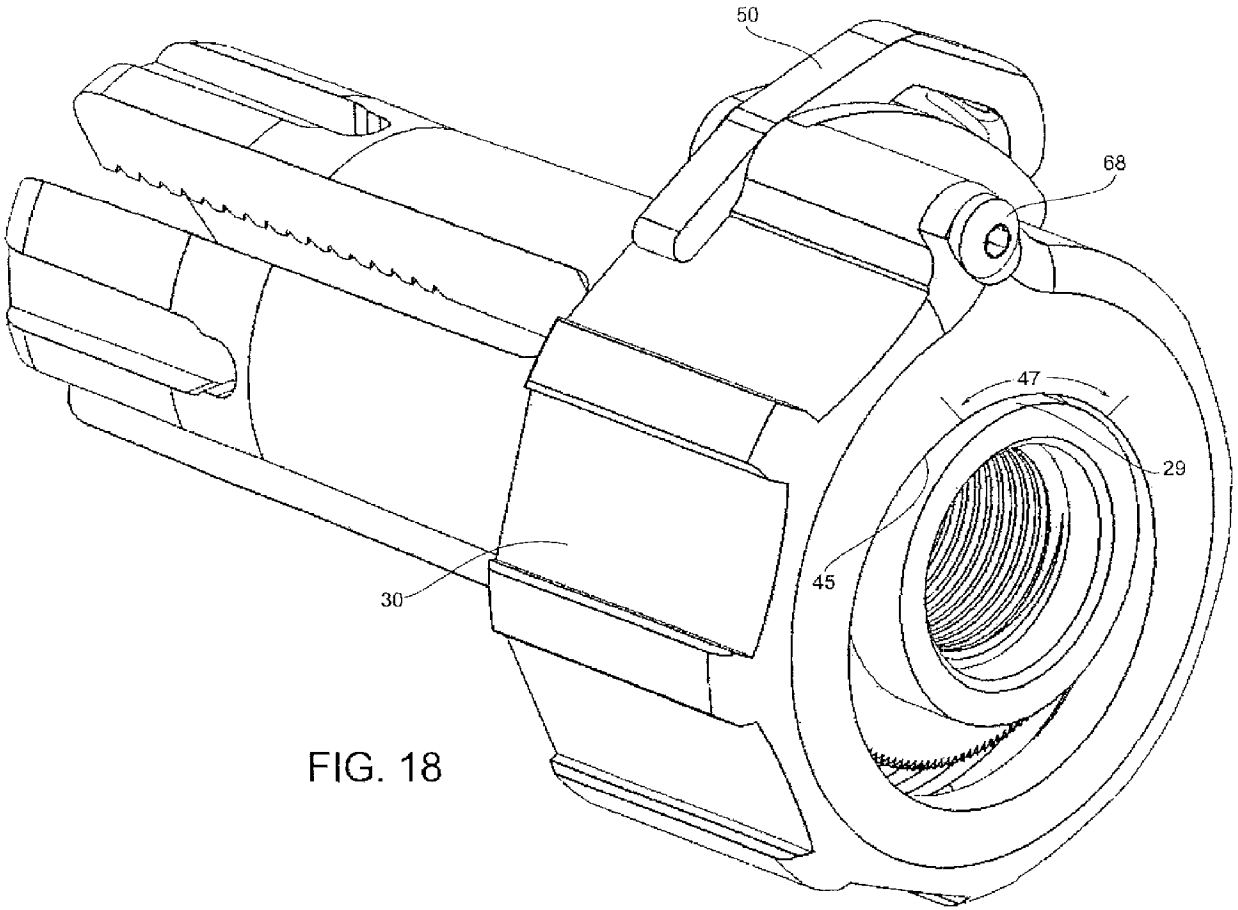
FIG. 18 shows the lock ring rotated into a locked orientation where the central axis of the front opening of the lock ring is now positioned offset from co-linear and substantially parallel from the central axis of the muzzle where it can be seen the engagement region is generally shown to be in forceful engagement with the muzzle which is shown here as the threaded adapter, such as a flash suppressor in accordance with an embodiment of the invention.

Now referring to FIG. 17, there is shown a flash suppressor 25 which in one embodiment is a portion of the muzzle 26 as shown in FIG. 1. In general, other types of muzzle end portions of a firearm can be utilized other than a flash suppressor, but for purposes of explanation, a flash suppressor having the threaded engagement portion 28 will be described as a mount portion for a firearm. In general, FIG. 17 shows only the lock ring 30 in the unlocked orientation. Now referring to FIG. 18, there is shown the lock ring 30 in the locked orientation, where it can be generally appreciated that the muzzle engagement region 47 of the non-concentric engagement surface 45 of the lock ring 30 is in tight virtual engagement with the lock surface region 29.

Figure 19:
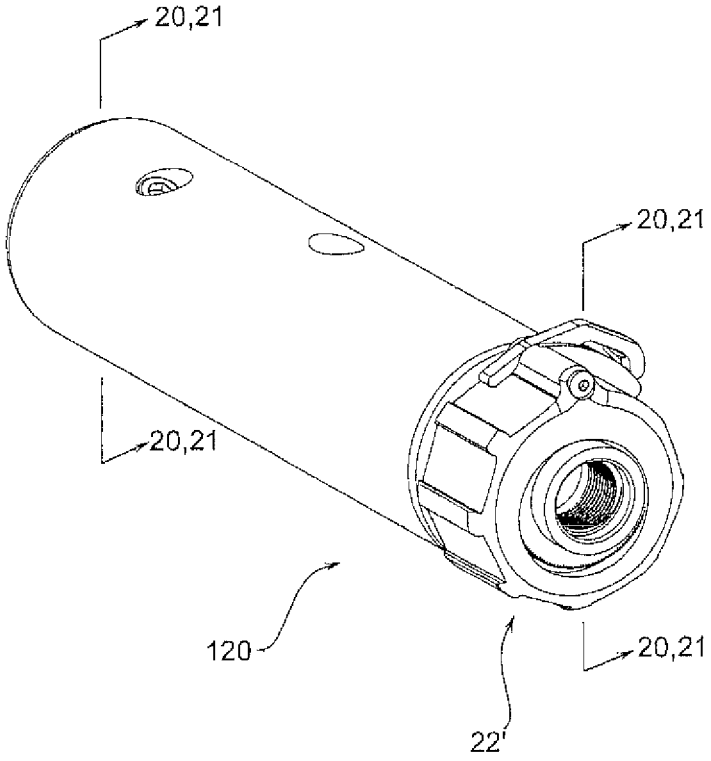
FIG. 19 shows a firearm attachment which is a blank firing adapter in accordance with an embodiment of the invention.

With the foregoing description in place, there will now be a description of a blank firing adapter 120 as shown in FIG. 19. In general, blank firing adapter 120 can be utilized with the locking assembly 22' as described in detail above, or other types of locking assemblies. Further, it should be reiterated that the locking assembly 22 as described in detail above can be utilized with any type of attachment to a firearm, such as a suppressor, blank firing assembly, flash suppressor, or even other types of devices herein not commonly utilized attached to a muzzle, such as an illuminating device, a blunt trauma impact attachment device, or other type of mechanism sought after to be rigidly attached to the end muzzle portion of a firearm, including long guns and pistols.

Figure 20:
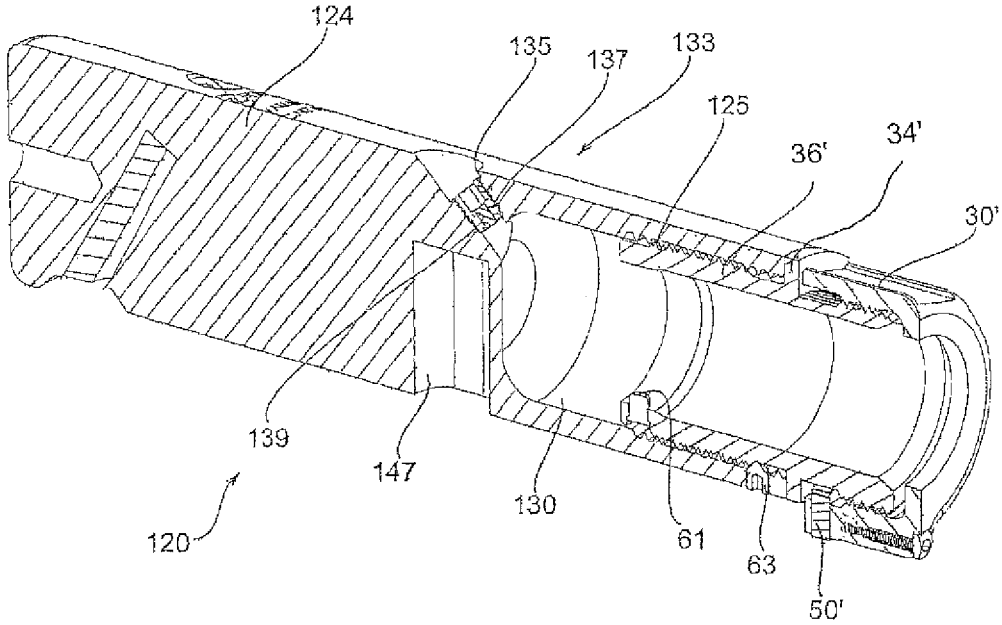
FIG. 20 shows a cross-sectional view taken along the plane in the lateral and vertical directions taken at line 20,21-20,21 of FIG. 19 in accordance with an embodiment of the invention.

Referring now to FIG. 20, there is shown an isometric view in cross-section of the blank firing adapter 120. In general, the blank firing adapter 120 comprises, in one embodiment, similar components of the base mount 34' and the lock ring 30' as described above, which comprises the lock-and-release lever 50. It should be noted that in one embodiment, the base mount 34' can be provided with an extension 61 which can, for example, be a set screw which is operatively configured to be fitted to a surface defining a longitudinally extending slide or slot in the muzzle 26 (see FIG. 24). Further, a lock member 63 can be employed, such as a set screw, to rigidly attach the base mount 34' to the main body 124 (as well as the base mount 34 to the body 24 as shown in FIGS. 1 and 2).

FIG. 20 generally shows the main body 124 as a unitary structure in one embodiment, where a surface defining an interior chamber 130 is present. In one embodiment, a portion of this chamber in the longitudinally rearward region provides a base attachment 125 which can be a female threaded attachment configured to engage the body attachment region 36' of the base mount 34'. The interior chamber 130 is provided with a bleed port 135 which provides access to the interior chamber and, in one embodiment, is provided with a fitting module, such as threads, to fit a common hexagonal thread pattern to be received by, for example, a hex screw. In general, an insert 137 operates as a bleed for adjusting the amount and volumetric rate of escaping gas therethrough when a blank cartridge is fired to the firearm. The surface defining a bleed orifice 139 can be adjusted and calibrated based on various parameters of the barrel length, the charge of the combusted material in the blank such as the burn rate and total amount of the powder contained therein, and other factors. In general, a plurality of inserts with a properly sized bleed orifice that provides cycling of the semiautomatic weapon without excessive gas blowback can be chosen for operation. At any rate, the bleed insert 137 provides adjustability of the escaping gas exiting the muzzle. Of course in the broader scope, other types of bleed adjustment systems 133 can be implemented, such as a dynamic iris-type system, a recessed screw having a frustoconical end adjusting the toroidal-shaped opening between the screw and an outer housing, a plurality of openings that can be selectively opened to provide access to the interior chamber 130, and a plurality of other mechanisms for adjusting the opening to allow gas to escape. It should be noted that in one embodiment, the bleed port 135 is pointed upwardly and forwardly. Of course this port could be oriented in a number of orientations; however, ejecting the gas upwardly, can aid in preventing a certain amount of muzzle lift.

As further shown in FIG. 20, there is a surface defining an escape port 147. As shown in the view taken along the lateral axis in FIG. 21, it can be appreciated that the escape port 147 is comprised of a longitudinally trailing surface 149 and a longitudinally forward surface 151. Further, the escape port 147 is provided with a barrier 153 which separates the escape port 147 from the interior chamber 130. In normal operation, expanding gas entering the interior chamber 130 will exit through the bleed adjustment system 133 in a manner as described above. However, in the event that the operator of the firearm places a live round into the chamber and initiates the firing sequence, a bullet will travel at a very high velocity (several thousand feet per second with a rifle) down the barrel, out the muzzle and be ejected into the blank firing adapter 120. In one embodiment, the projectile receiving area is operatively configured to have three rounds of a projectile weighing no more than 80 grams traveling at not greater than 3000 feet per second be contained therein when fired from the firearm. The blank firing adapter 120 is not intended to have bullets passing therethrough in normal operation. However, the adapter 120 is designed with safety features to warn the operator of the firearm that a live round is being shot, and further mitigate damage from the live round which has been fired.

In normal operation, the blank firing adapter will produce a sound of approximately 128 dB. Other sound levels (e.g., volumes) may be present in other embodiments. If a live round were to pass into the blank firing adapter 120 the sound would escalate in one embodiment to 154 dB. Other escalated sound levels (e.g., volumes) may be present in other embodiments. In normal operation the volume of sound is attributed to a portion of the gas exiting through the bleed adjustment system 133, as well as other noises created from the operation of the firearm and bleeding gas through other portions, such as the gas return line to operate the bolt of the firearm. The barrier 153 has a thickness to allow the projectile to break therethrough. In one embodiment the barrier has a thickness of 0.100 inch. Other thicknesses may be used in other embodiments. The broader range can be 0.030" to 0.700" in one embodiment. Other ranges may be used in other embodiments. The material in one embodiment is aluminum 7075 or other materials having a strength range sufficient to slow projectiles and preferably allow them to eject downwardly. The material may be further configured to have the projectile bullet pierce through the barrier 153 thereby causing sound to be emitted from the escape port 147. In general, the decibel rating of a bullet actually passing through the barrier 153 is much greater (e.g., greater than 10 dB from normal operation) than when a blank is fired to provide clear indication to the shooter that something is wrong. Other decibel ratings may be present in other embodiments.

Figure 21:
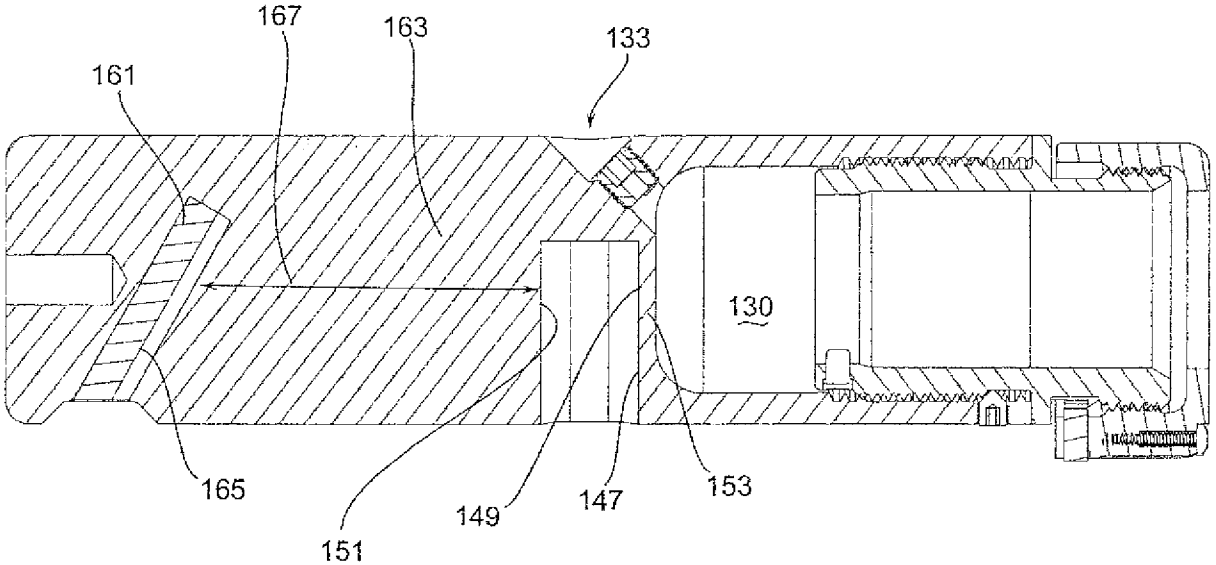
FIG. 21 is a sectional view of the firearm blank firing adapter taken along the lines 20,21-20,21 of FIG. 19 in accordance with an embodiment of the invention.

As further shown in FIG. 21, there is a projectile redirection plate 161 fitted in a longitudinally forward portion of the main body 124. If multiple rounds are fired, a projectile receiving area 163 will generally allow these bullets to pass through the solid material, which is a metallic material such as aluminum in one embodiment but can include other materials such as polymers, steels, composites, and brass. Other methods of capturing bullets could be utilized such as threading a cone shaped cup into the front portion of the main body. The projectile redirection plate 161 in one embodiment has an engagement surface 165 that is pointed forward and downward based in the longitudinally rearward to forward directions so as to impart any bullets impacting thereupon downwardly to prevent impacting anyone down-range from the firearm. The projectile receiving area 163 in one embodiment has an approximate prescribed length indicated by a dimension 167 that is between 1 and 3 inches and has been made at 2" in width, given the strength of the material, such as aluminum 7075, however other lengths and widths may be used in other embodiments. Therefore, one reason that there is a distance of approximately ½"-¾" in one embodiment (e.g., other distances may be used in other embodiments) between the longitudinally trailing surface 149 and the longitudinally forward surface 151 is to provide a sufficiently short distance 167 of the projectile receiving area 163 so the bullets imparted therethrough will be sufficiently slow but will continue to the projectile redirection plate 161. In other words, if the projectile receiving area 163 is too long, the bullets passing therethrough may stack up or otherwise be redirected into lateral and upper locations, which are less desirable areas for the dispersion of bullets. In particular, if the firearm is on full auto mode, several bullets may pass down the muzzle and enter the blank firing adapter 120 before the operator of the firearm has realized that live rounds are being fired.

Figure 22:
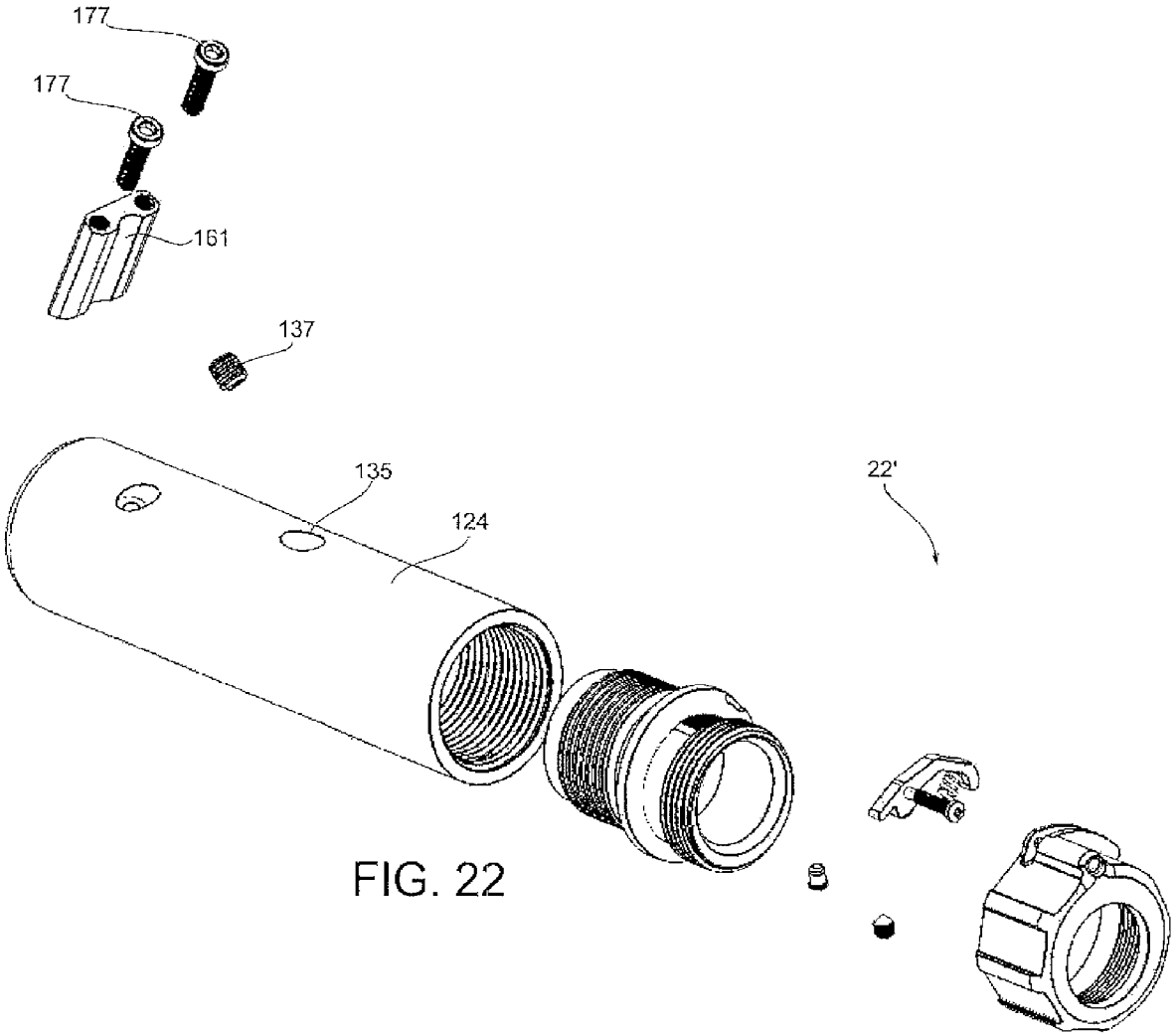
FIG. 22 shows an exploded view of the firearm blank adaptor in accordance with an embodiment of the invention.
Figure 23:
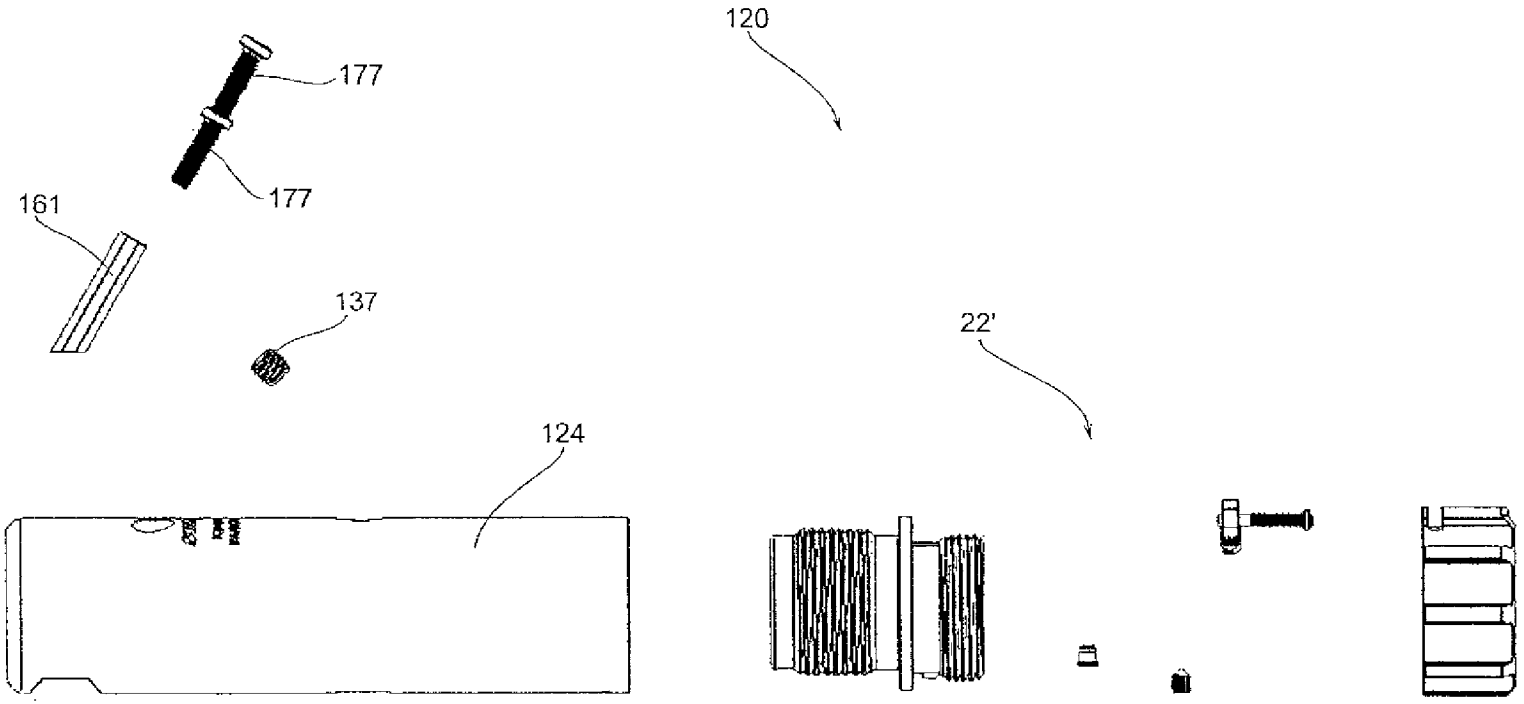
FIG. 23 shows a side profile view of the firearm blank adaptor in accordance with an embodiment of the invention.
Figure 24:
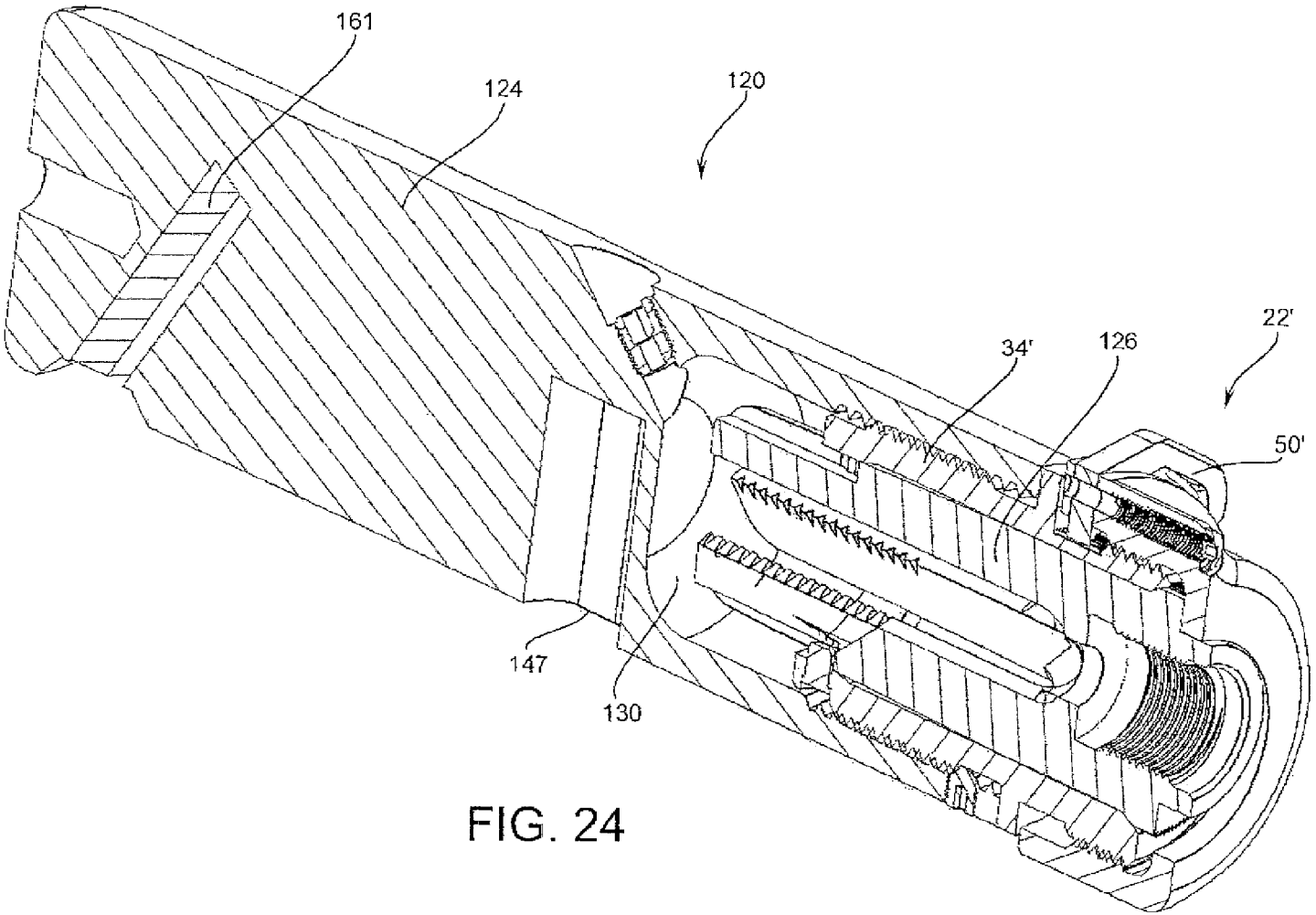
FIG. 24 shows an isometric cross-sectional view of a firearm blank adaptor showing a portion of the muzzle such as a flash suppressor positioned therein a locked orientation in accordance with an embodiment of the invention.

As shown in FIG. 22, there is an exploded view where the main body 124 is shown and the bleed port 135 is provided where the bleed adjustment insert 137 is shown in an exploded embodiment. The projectile redirection plate 161 in one embodiment is of a different harder metal than that of the main body 124. The projectile redirection plate 161 can be fastened in the upper portion by the fasteners 177 with a portion of the main body interposed between the annular heads thereof. Shown in the right-hand portion of FIG. 22 is one embodiment of a locking assembly 22' which is similar in nature as described above. FIG. 23 shows a side view of the exploded blank firing adapter 120. FIG. 24 shows a cross-sectional view where, in this embodiment, the blank firing adapter 120 shows a muzzle 126 inserted therein where one embodiment of the muzzle is an attachment to the forward portion of the barrel where the barrel and the attachment generally form a muzzle region of the firearm. For purpose of explanation, the muzzle 126 which, in one embodiment, is a suppressor is shown unthreaded but could, for example, be threaded to a threaded region 327 of a barrel as shown by example in FIG. 26.

Figure 25:
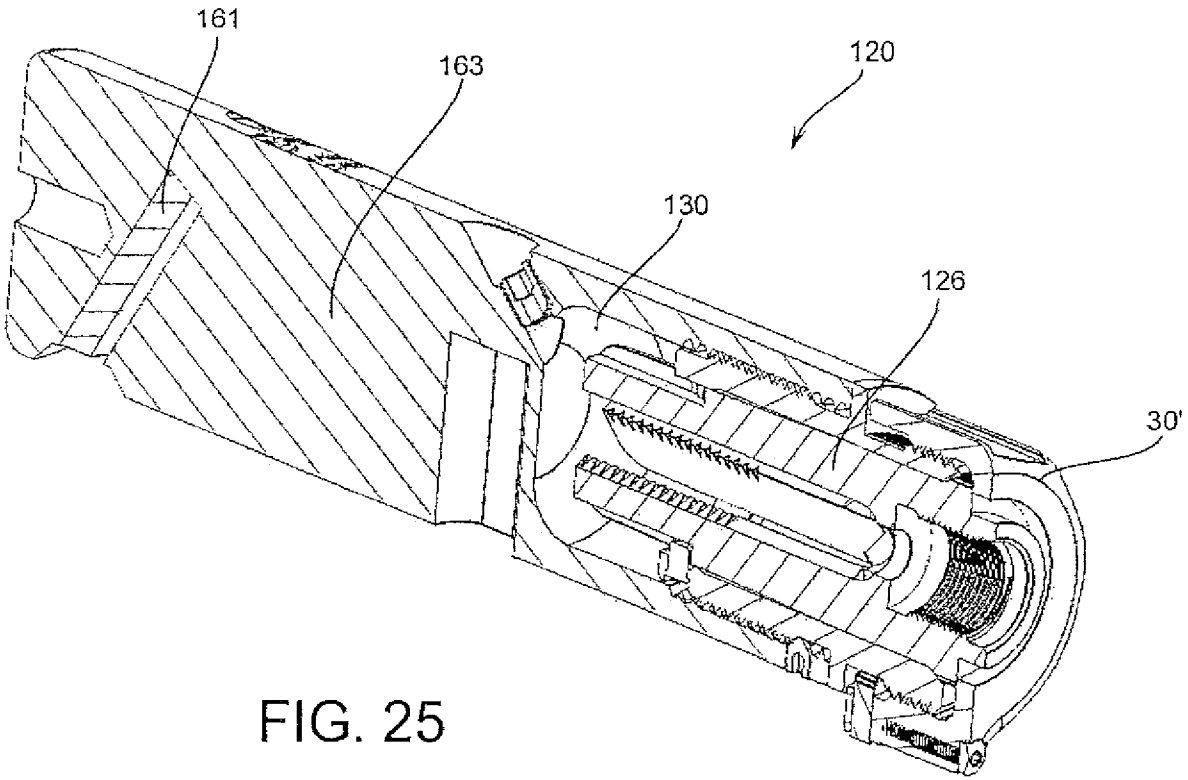
FIG. 25 shows the blank firing adapter with a portion of a muzzle positioned therein with the lock ring in an unlocked orientation in accordance with an embodiment of the invention.

It should be reiterated that the locking assembly 22' can be utilized with any type of attachment mechanism for the muzzle region of a firearm. In one embodiment, this locking assembly 22' is shown with a blank firing adapter. FIG. 25 shows by way of example how the lock ring 30' is in an unlocked orientation whereby the muzzle of the firearm 126 (shown as a flash suppressor) can be withdrawn from the interior chamber 130.

Therefore, the embodiment as described above and generally shown in FIGS. 19-25 is operatively configured to have three rounds be held within the main body at the projectile receiving area 163, and all rounds passing therethrough thereafter will be redirected forwardly and downwardly by way of the projectile redirection plate 161. Other embodiments configured with other numbers of rounds are also contemplated. If the vector distance 167 as shown in FIG. 21 is too long, the rounds can take a more lateral and vertical path and not strike the projection redirection plate. In general, the blank firing adapter 120 can generally have a diameter between 1 and 3 inches in a broader range. In one embodiment, the range is approximately 1.5 inches. Other ranges may be used in other embodiments. Of course the relationship of the diameter to the length of the projectile receiving area 163 can be important for ensuring that the projectiles do not exit laterally but are rather redirected forwardly to be redirected by the projectile redirection plate 161.

Figure 26:
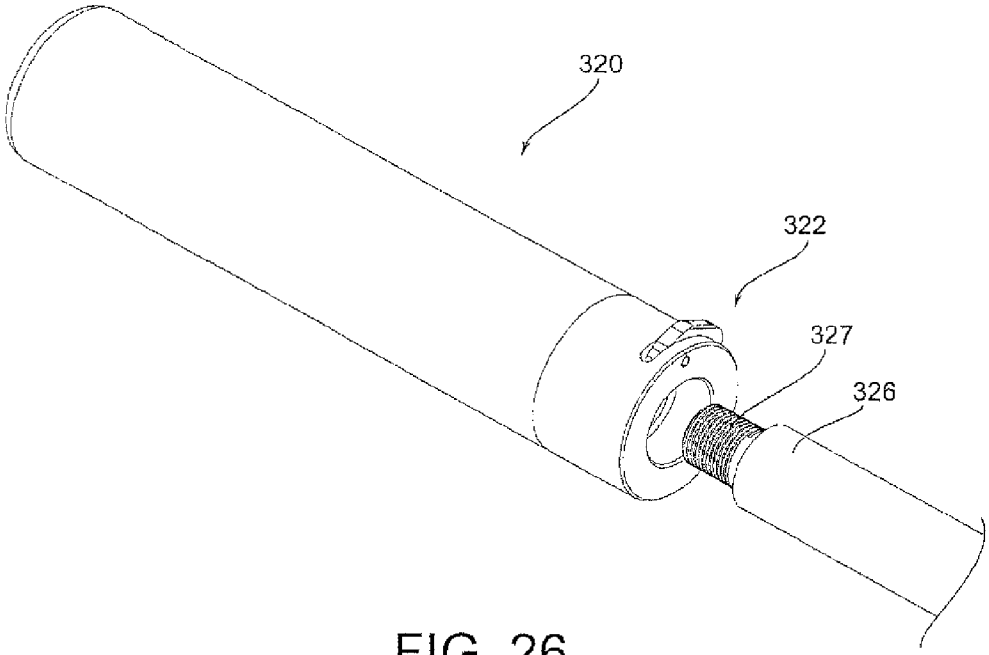
FIG. 26 shows another embodiment where a general firearm attachment is shown positioned adjacent to a muzzle which has a threaded front portion in accordance with an embodiment of the invention.
Figure 27:
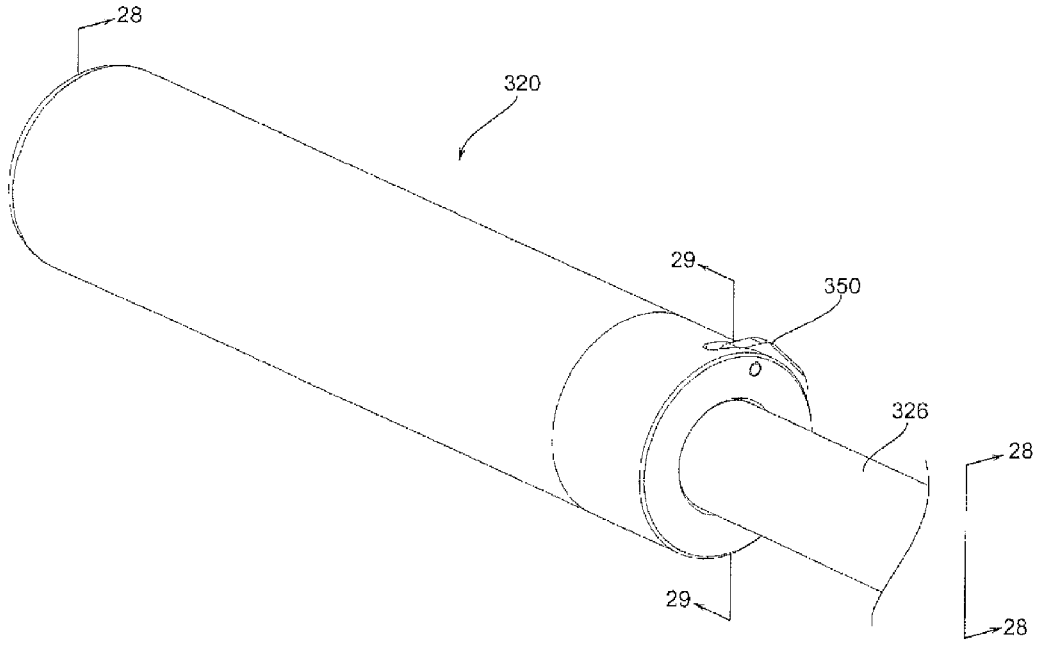
FIG. 27 shows the firearm attachment attached to the muzzle in accordance with an embodiment of the invention.
Figure 28:
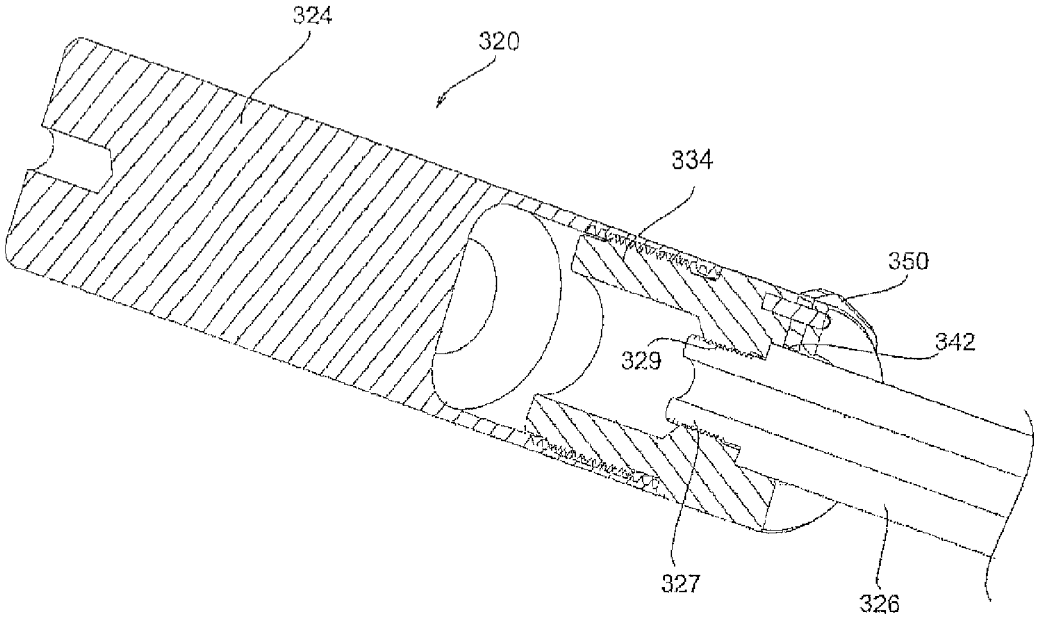
FIG. 28 shows the firearm attachment shown in cross-sectional view taken along line 28-28 of FIG. 27 in accordance with an embodiment of the invention.

Now referring to FIG. 26 there is shown another embodiment of a locking assembly 322. In general, in this embodiment, there is a muzzle 326 which is configured to fit within the suppressor or blank firing adapter, otherwise referred to as the firearm attachment 320. Now referring to FIG. 28 there is shown a cross-sectional view taken at line 28-28 of FIG. 27 which shows the firearm attachment 320 attached to the muzzle 326. It can be appreciated in FIG. 28 that the forward region 327 of the muzzle 326 is provided with a threaded region which in one embodiment is a male threaded region operatively configured to be fitted to the firearm attachment 320 at a muzzle engagement region 329. Of course one traditional method of attaching a suppressor or other embodiments of firearm attachments is to threadedly engage such attachments to a threaded portion of the muzzle. In one embodiment the firearm attachment 320 can be provided with a base mount 334 and a body 324, but there is a plurality of methods of arranging the components or providing a unitary structure for the firearm attachment 320. For purposes of discussion, FIG. 27 shows a hatched view of a variant of a blank firearms adapter, but could also be a suppressor, flash suppressor, or other type of attachment mechanism. It should be noted that a locking release lever 350, which is shown in partial sectional view, now directly engages the muzzle and the muzzle provides a locking surface 342.

Figure 29:
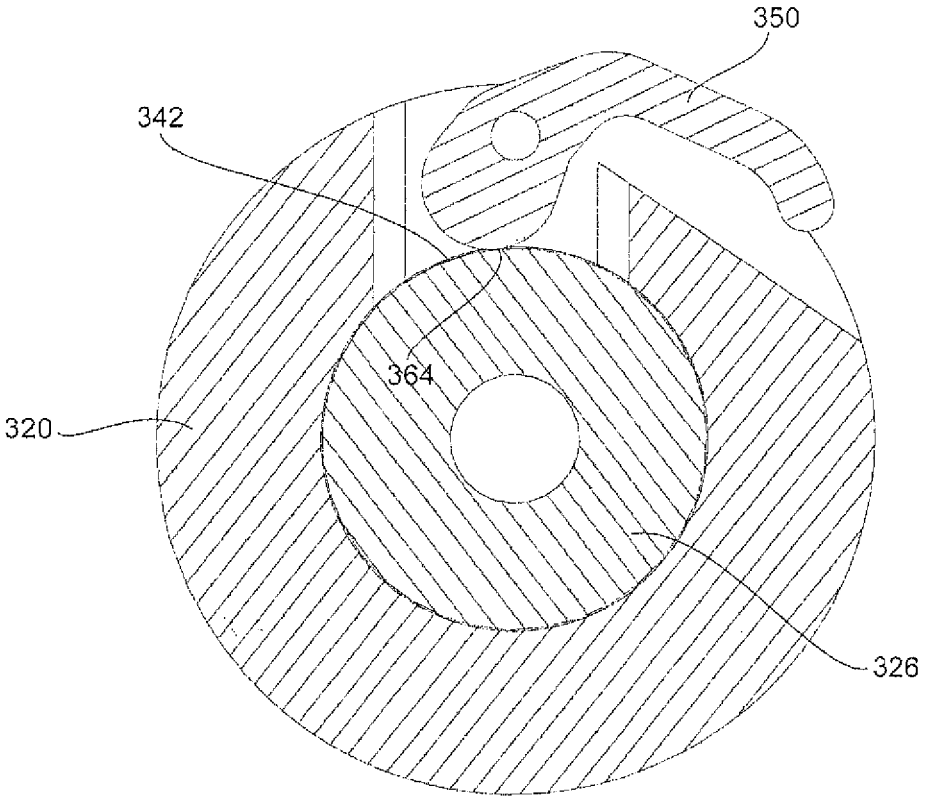
FIG. 29 shows a cross-sectional view taken from line 29-29 of FIG. 27 in accordance with an embodiment of the invention.

Now referring to FIG. 29 there is shown a cross-sectional view taken at line 29-29 of FIG. 27 where the lock-and-release lever 350 can be shown to have a locking engagement surface 364 that directly engages the locking surface 342, which, in this case, is directly upon the muzzle 326. Of course, various other embodiments of the surfaces 364 and 342 can be provided, as described above in the various FIGS. 7A-7G as well as other possible arrangements as defined above.

Figure 30:
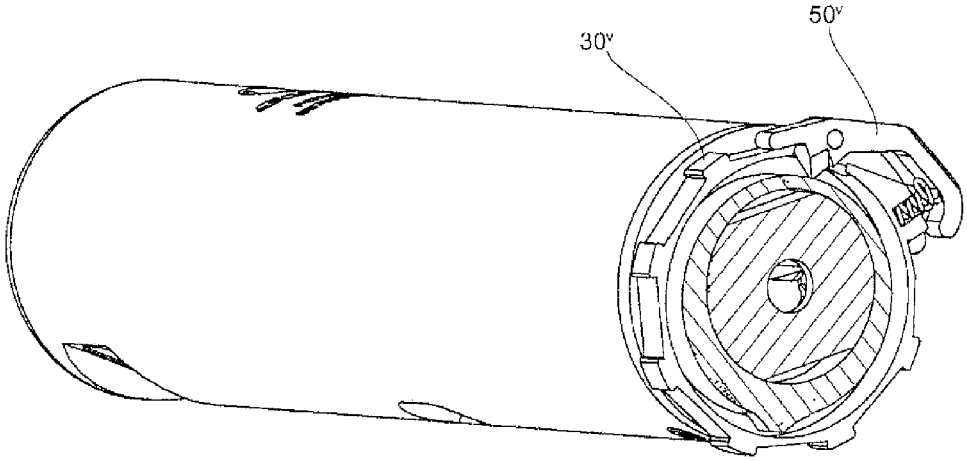
FIG. 30 shows another embodiment of a lock lever in accordance with an embodiment of the invention.
Figure 31:
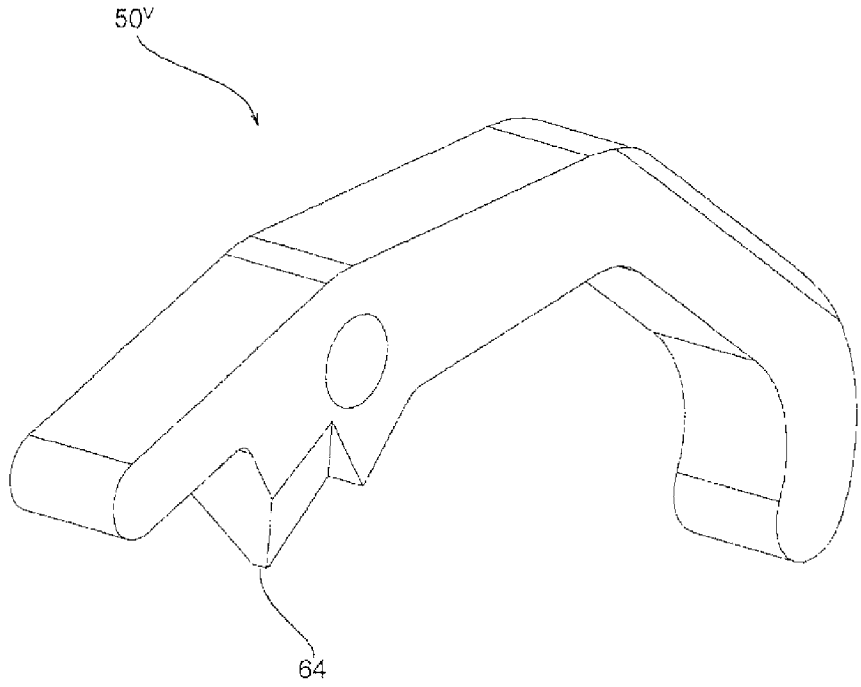
FIG. 31 shows an orthogonal view of the lock lever of FIG. 30 showing a smaller engagement region that tapers in the tangential and longitudinal directions in accordance with an embodiment of the invention.
Figure 32:
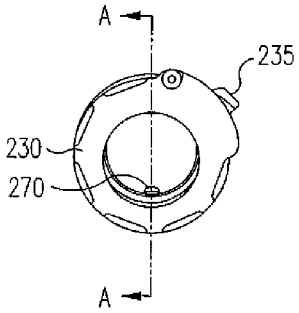
FIG. 32 is a boresight view into a proximal end of a blank safety device in accordance with an embodiment of the disclosure
Figure 34:
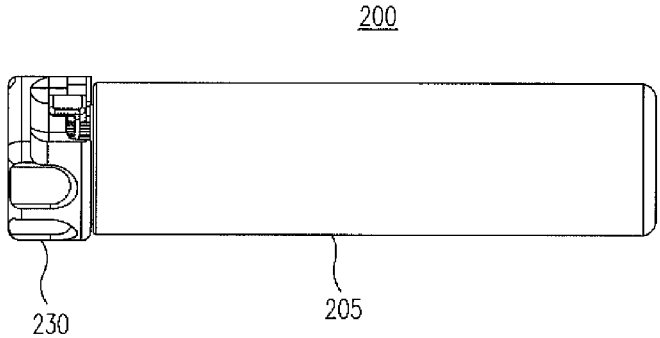
FIG. 34 is a side view of the blank safety device of FIG. 32.

Now referring to FIG. 30 there is shown yet another embodiment where a lock-and-release lever 50V is attached to a lock ring 30V in a similar manner as described above; however, as shown in FIG. 31, it can be seen that the lock-and-release lever 50V is arranged in such a manner that the lock engagement surface 64 is not only narrowed in the tangential direction but further in the longitudinal direction to find a point of contact. Basically, depending upon the hardness of the materials, a finer point can be utilized.

Referring again to FIGS. 24 and 25, deflection plate 161 acts to deflect a live round that is boring distally through main body 24 as a result of a user accidentally chambering and firing a live round instead of a blank cartridge. Although that deflection advantageously prevents a round from piercing through a distal end of main body 24, the deflection can still result in a bullet leaving main body 24 downwardly at an oblique angle. An alternative embodiment for a blank firearm adapter 200 is shown in FIGS. 32 through 35 that prevents such an exit of a fired bullet.

Figure 33:
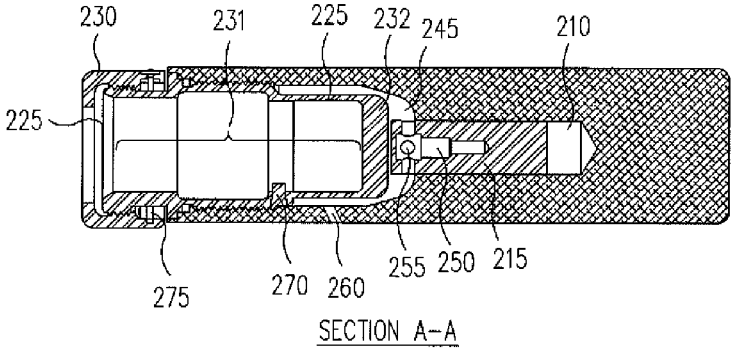
FIG. 33 is a cross-sectional view of the blank safety device of FIG. 32 taken along line A-A.
Figure 35:
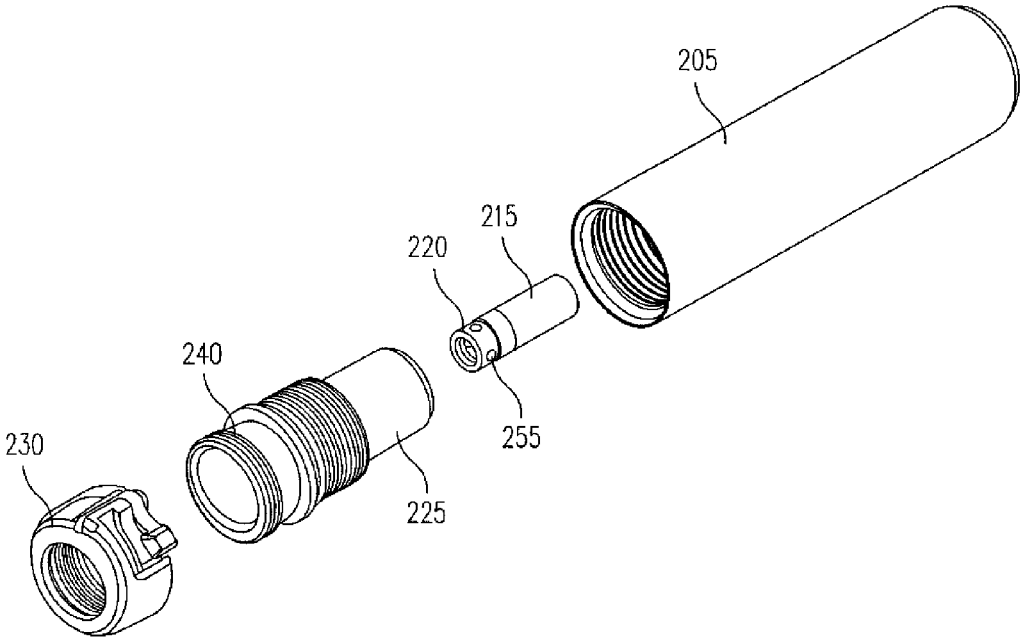
FIG. 35 is an isometric exploded view of the blank safety device of FIG. 32.

As best seen in the cross-sectional view of FIG. 33 as well as the exploded view of FIG. 35, a body 205 for blank firearm adapter 200 includes a distally extending closed-end bore or cylindrical cavity 210 that receives a bullet plug 215. Bullet plug 215 has a slightly larger diameter than the diameter for bore 210 so as to achieve a press fit within bore 210. A proximal end portion 220 of bullet plug 215 has a larger diameter than the diameter for the remaining bore-inserted portion of bullet plug 215. In this fashion, proximal end portion 220 acts as a stop to prevent further distal displacement of bullet plug 215 within bore 210 during manufacture and normal use (no live rounds). However, the explosive force of a fired bullet (not illustrated) will overcome the stopping action of proximal end portion 220 so that bullet plug 215 distally displaces within bore 210 towards a closed distal end of bore 210 after an accidental discharge of a live round. This distal displacement helps slow the bullet within body 205 of blank firearm adapter 200, thus advantageously preventing a fired bullet from exiting blank firearm adapter 200.

To distinguish this internal stopping of a bullet as opposed to a deflection and possible exit of a bullet, blank firearm adapter 200 is also denoted herein as a blank safety device 200. Blank firearm adapter or blank safety device 200 attaches to a distal end of a firearm attachment (such as a flash suppressor, a silencer, or a suitable adapter on a firearm barrel) using a locking ring attachment as discussed above. Thus, as best shown in FIG. 35, back section 225 includes a threaded outer circumference at its distal end configured to threadably engage a corresponding threaded inner circumference at a proximal end of body 205. In addition, back section 225 includes a threaded outer circumference at its proximal end configured to threadably engage an inner circumference of a locking ring 230. Locking ring 230 includes a lock engagement surface on a lock extension (not illustrated) as also discussed above with regard to analogous firearm-attachments-with-locking rings that engages with teeth or other suitable features on a locking surface 240 of back section 225. In this fashion, the non-concentric inner surface of locking ring 230 may be locked into position after a user rotates locking ring 230 such that the non-concentric inner surface engages with the firearm or firearm attachment.

Blank cartridges do not develop the gas pressures that result from firing a live round. Instead, the gas pressures are markedly reduced. Thus, back section 225 is substantially hollow such that it encloses a central bore 231 with no vents in one embodiment. Instead, gas would enter the open proximal end of blank safety device 200 and be trapped within back section 225. In this fashion, sufficient gas pressures are developed to adequately cycle the automatic loading mechanism in the blank-firing firearm that blank safety device 200 services. Central bore 231 thus has a closed distal end in one embodiment to enable blank cartridges to develop sufficient gas pressure to cycle automatic and semi-automatic firearms.

Body 205 may comprise aluminum or an aluminum alloy to reduce weight. However, back section 225 may comprise stainless steel for greater strength with regard to the ensuing gas pressures from blank firing. Although a distal back wall 232 for back section 225 may be thickened (for example, approximately a quarter-of-an-inch thick) so as to aid in slowing a live round, it will be distally pierced by the fired bullet. In turn, bullet plug 215 (which also may comprise stainless steel in one embodiment) will receive the bullet in a distally-extending bore 250 after it tears through the distal end wall of back section 225. Bullet plug bore 250, which has an open proximal end and a closed distal end, may be stepped so to narrow in the distal direction to aid in slowing the distally-traveling bullet. Proximal portion 220 of bullet plug 215 includes a plurality of radially-extending ports 255 that open into bore 250. In this fashion, gases from an expended live round can exit into an enlarged cavity 245 within body 205 that surrounds a distal portion of back section 225. The gases from a live round may thus travel into cavity 245 after the traveling bullet pierces back wall 232 of back section 225 so as to then escape to the external environment through a port 260 in a sidewall of body 205. Port 260 can be angled downwardly in the distal direction so as to deflect the gases away from the shooter and down toward the ground. The shooter will then be apprised of their mistake in chambering a live round by the ensuing gun blast and smoke that will issue from port 260. Because back section 225 is otherwise sealed during normal (blank-firing) operation, the user will notice a marked difference in that fired blank cartridges will produce a softer gun blast without any gases issuing from port 260. In contrast, a live round will be much louder as the gun blast is able to escape through port 260.

In one embodiment, a pin 270 extends radially within back section 225 to act as a stop to the gun attachment that blank safety device 200 couples to. A user depresses a push button 235 on the locking ring to bias its lock extension away from locking surface 240 with respect to a spring force developed by a spring locking ring 275. With the lock extension biased away from locking surface 240, a user may remove blank safety device from the firearm attachment as analogously discussed above with regard to other locking ring embodiments.

Where applicable, the various components set forth herein can be combined into composite components and/or separated into sub-components without departing from the spirit of the present invention. Similarly, where applicable, the ordering of various steps described herein can be changed, combined into composite steps, and/or separated into sub-steps to provide features described herein. Embodiments described above illustrate but do not limit the invention. It should also be understood that numerous modifications and variations are possible in accordance with the principles of the present invention. Accordingly, the scope of the invention is defined only by the following claims.

What is claimed is:

1. A blank safety device, comprising:

a body defining a cylindrical bore comprising a closed distal end, the body also defining a proximally extending internal cavity in communication with the cylindrical bore;

a bullet plug partially received within the cylindrical bore, the bullet plug comprising a proximal portion with a diameter greater than that of the cylindrical bore to act as a stop against further insertion of the bullet plug within the cylindrical bore such that a distal end of the bullet plug remains displaced away from the closed distal end of the cylindrical bore during blank firing operation, the bullet plug configured to distally displace within the cylindrical bore towards the closed distal end of the cylindrical bore in response to the impact of a fired live round; and a back section received within the internal cavity in the body, the back section defining a central bore that is sealed at a distal end of the back section and open at a proximal end of the back section to receive a firearm attachment.

2. The blank safety device of claim 1, wherein a sidewall of the body comprises a port extending therethrough to the internal cavity.

3. The blank safety device of claim 1, wherein the bullet plug defines an internal bore; and wherein a sidewall of the proximal portion of the bullet plug comprises a plurality of ports extending therethough to the internal bore and in communication with the internal cavity.

4. The blank safety device of claim 1, further comprising a locking ring rotatably attached to the back section to engage the firearm attachment.

5. The blank safety device of claim 4, wherein the locking ring comprises a non-concentric engagement surface configured to engage the firearm attachment in response to rotation of the locking ring.

6. The blank safety device of claim 1, wherein the body comprises aluminum.

7. The blank safety device of claim 1, wherein the bullet plug comprises steel.

8. The blank safety device of claim 1, wherein the back section comprises steel.

9. The blank safety device of claim 1, wherein the internal cavity at least partially surrounds the sealed distal end of the back section, the internal cavity comprising at least one port to an external environment of the blank safety device.

10. The blank safety device of claim 1, wherein the bullet plug comprises an internal bore that extends from an open proximal end in communication with the internal cavity to a closed distal end.

11. The blank safety device of claim 10, wherein the internal bore of the bullet plug comprises a diameter that narrows towards the closed distal end.

12. The blank safety device of claim 11, wherein the internal bore of the bullet plug is in communication with a plurality of radially-extending ports.

13. A method of indicating to a user that a live round has been fired using a blank safety device, the method comprising:

attaching the blank safety device to a firearm, wherein the blank safety device comprises:

a body defining a cylindrical bore comprising a closed distal end, the body also defining a proximally extending internal cavity in communication with the cylindrical bore, a bullet plug partially received within the cylindrical bore, the bullet plug comprising a proximal portion with a diameter greater than that of the cylindrical bore to act as a stop against further insertion of the bullet plug within the cylindrical bore such that a distal end of the bullet plug remains displaced away from the closed distal end of the cylindrical bore during blank firing operation, the bullet plug configured to distally displace within the cylindrical bore towards the closed distal end of the cylindrical bore in response to the impact of the live round, and a back section received within the internal cavity in the body, the back section defining a central bore that is sealed at a distal end of the back section and open at a proximal end of the back section to receive a firearm attachment; and firing the live round through the firearm into the attached blank safety device.

14. The method of claim 13, further comprising:

receiving the live round in the bullet plug;

distally displacing the bullet plug within the cylindrical bore towards the closed distal end of the cylindrical bore in response to the receiving; and retaining the live round within the blank safety device.

15. The method of claim 13, wherein attaching the blank safety device comprises rotating a locking ring.

16. The method of claim 15, wherein rotating the locking ring engages a non-concentric surface of the locking ring with the firearm attachment.

17. The method of claim 13, wherein the internal cavity at least partially surrounds the sealed distal end of the back section, the internal cavity comprising at least one port to an external environment of the blank safety device; and wherein the live round pierces the sealed distal end of the back section such that a gun blast travels through the internal cavity and through the port to the external environment to alert the user that a live round was fired.

* * * * *